US008833471B2

(12) United States Patent
Wiens et al.

(10) Patent No.: US 8,833,471 B2
(45) Date of Patent: Sep. 16, 2014

(54) FILL UP TOOL

(75) Inventors: Jimmy Duane Wiens, Willis, TX (US); Yury P. Gutsu, Houston, TX (US); Benson Thomas, Missouri City, TX (US); Karsten Heidecke, Houston, TX (US); Jim Hollingsworth, Cypress, TX (US); Doyle Fredric Boutwell, Jr., Houston, TX (US); Rodney Stephens, Houston, TX (US); Russell W. Thompson, Hallsville, TX (US); Patrick James Zimmerman, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 381 days.

(21) Appl. No.: 13/206,313

(22) Filed: Aug. 9, 2011

(65) Prior Publication Data

US 2012/0048574 A1 Mar. 1, 2012

Related U.S. Application Data

(60) Provisional application No. 61/401,193, filed on Aug. 9, 2010, provisional application No. 61/372,052, filed on Aug. 9, 2010, provisional application No. 61/516,137, filed on Mar. 30, 2011.

(51) Int. Cl.

| | |
|---|---|
| ***E21B 19/18*** | (2006.01) |
| ***E21B 21/00*** | (2006.01) |
| ***E21B 21/08*** | (2006.01) |
| ***E21B 23/06*** | (2006.01) |

(52) U.S. Cl.

CPC ..... *E21B 21/00* (2013.01); *E21B 21/08* (2013.01); *E21B 23/06* (2013.01)

USPC ..... 166/380; 166/77.1; 166/77.52; 166/177.4

(58) Field of Classification Search

USPC ..... 166/380, 379, 77.1, 77.52, 177.4

See application file for complete search history.

(56) References Cited

U.S. PATENT DOCUMENTS

| | | | |
|---|---|---|---|
| 1,367,156 | A | 2/1921 | McAlvay et al. |
| 1,822,444 | A | 9/1931 | MacClatchie |
| 3,147,992 | A | 9/1964 | Haeber et al. |
| 3,385,370 | A | 5/1968 | Knox et al. |
| 3,698,426 | A | 10/1972 | Litchfield et al. |
| 3,888,318 | A | 6/1975 | Brown |

(Continued)

FOREIGN PATENT DOCUMENTS

| | | |
|---|---|---|
| EP | 1 260 671 | 11/2002 |
| EP | 1 019 614 | 7/2006 |

(Continued)

OTHER PUBLICATIONS

PCT Partial International Search for International Application No. PCT/US2011/047145 dated Jan. 8, 2013.

(Continued)

*Primary Examiner* — Cathleen Hutchins

(74) *Attorney, Agent, or Firm* — Patterson & Sheridan, L.L.P.

(57) ABSTRACT

A fill up tool includes a mandrel; a primary sealing member disposed around the mandrel; and a selectively operable secondary sealing member activated by rotation of the mandrel. In another embodiment, the selectively operable secondary sealing member is activated using hydraulic pressure.

21 Claims, 24 Drawing Sheets

(56) References Cited

U.S. PATENT DOCUMENTS

| | | | | |
|---|---|---|---|---|
| 3,899,024 | A * | 8/1975 | Tonnelli et al. | 166/72 |
| 4,364,407 | A | 12/1982 | Hilliard | |
| 4,377,179 | A | 3/1983 | Giebeler | |
| 4,478,244 | A | 10/1984 | Garrett | |
| 4,776,617 | A | 10/1988 | Sato | |
| 4,779,688 | A | 10/1988 | Baugh | |
| 4,955,949 | A | 9/1990 | Bailey et al. | |
| 4,962,819 | A | 10/1990 | Bailey et al. | |
| 4,997,042 | A | 3/1991 | Jordan et al. | |
| 5,036,927 | A | 8/1991 | Willis | |
| 5,152,554 | A | 10/1992 | LaFleur et al. | |
| 5,172,940 | A | 12/1992 | Usui et al. | |
| 5,191,939 | A | 3/1993 | Stokley | |
| 5,282,653 | A | 2/1994 | LaFleur et al. | |
| 5,348,351 | A | 9/1994 | LaFleur et al. | |
| 5,441,310 | A | 8/1995 | Barrett et al. | |
| 5,456,320 | A * | 10/1995 | Baker | 166/377 |
| 5,479,988 | A | 1/1996 | Appleton | |
| 5,501,280 | A | 3/1996 | Brisco | |
| 5,509,442 | A | 4/1996 | Claycomb | |
| 5,577,566 | A | 11/1996 | Albright et al. | |
| 5,584,343 | A | 12/1996 | Coone | |
| 5,645,131 | A | 7/1997 | Trevisani | |
| 5,682,952 | A | 11/1997 | Stokley | |
| 5,735,348 | A | 4/1998 | Hawkins, III | |
| 5,918,673 | A | 7/1999 | Hawkins et al. | |
| 5,971,079 | A | 10/1999 | Mullins | |
| 5,992,520 | A | 11/1999 | Schultz et al. | |
| 6,053,191 | A | 4/2000 | Hussey | |
| 6,102,116 | A | 8/2000 | Giovanni | |
| 6,173,777 | B1 | 1/2001 | Mullins | |
| 6,279,654 | B1 | 8/2001 | Mosing et al. | |
| 6,289,911 | B1 | 9/2001 | Majkovic | |
| 6,309,002 | B1 | 10/2001 | Bouligny | |
| 6,390,190 | B2 | 5/2002 | Mullins | |
| 6,401,811 | B1 | 6/2002 | Coone | |
| 6,415,862 | B1 | 7/2002 | Mullins | |
| 6,431,626 | B1 | 8/2002 | Bouligny | |
| 6,443,241 | B1 | 9/2002 | Juhasz et al. | |
| 6,460,620 | B1 | 10/2002 | LaFleur | |
| 6,536,520 | B1 | 3/2003 | Snider et al. | |
| 6,571,876 | B2 | 6/2003 | Szarka | |
| 6,578,632 | B2 | 6/2003 | Mullins | |
| 6,595,288 | B2 | 7/2003 | Mosing et al. | |
| 6,604,578 | B2 | 8/2003 | Mullins | |
| 6,640,824 | B2 | 11/2003 | Majkovic | |
| 6,666,273 | B2 | 12/2003 | Laurel | |
| 6,675,889 | B1 | 1/2004 | Mullins et al. | |
| 6,691,801 | B2 | 2/2004 | Juhasz et al. | |
| 6,715,542 | B2 | 4/2004 | Mullins | |
| 6,719,046 | B2 | 4/2004 | Mullins | |
| 6,722,425 | B2 | 4/2004 | Mullins | |
| 6,732,819 | B2 | 5/2004 | Wenzel | |
| 6,779,599 | B2 | 8/2004 | Mullins et al. | |
| 6,832,656 | B2 | 12/2004 | Fournier, Jr. et al. | |
| 6,883,605 | B2 | 4/2005 | Arceneaux et al. | |
| 6,976,298 | B1 | 12/2005 | Pietras | |
| 7,007,753 | B2 | 3/2006 | Robichaux et al. | |
| 7,017,671 | B2 | 3/2006 | Williford | |
| 7,096,948 | B2 | 8/2006 | Mosing et al. | |
| 7,147,254 | B2 | 12/2006 | Niven et al. | |
| 7,370,698 | B2 | 5/2008 | Mosing et al. | |
| 7,490,677 | B2 | 2/2009 | Buytaert et al. | |
| 7,635,026 | B2 | 12/2009 | Mosing et al. | |
| 7,665,515 | B2 | 2/2010 | Mullins | |
| 7,690,422 | B2 | 4/2010 | Swietlik et al. | |
| 7,694,730 | B2 | 4/2010 | Angman | |
| 7,694,744 | B2 | 4/2010 | Shahin | |
| 7,699,121 | B2 | 4/2010 | Juhasz et al. | |
| 7,866,390 | B2 | 1/2011 | Latiolais, Jr. et al. | |
| 7,874,361 | B2 | 1/2011 | Mosing et al. | |
| 7,878,237 | B2 | 2/2011 | Angman | |
| 8,118,106 | B2 | 2/2012 | Wiens et al. | |
| 2002/0084069 | A1 | 7/2002 | Mosing et al. | |
| 2002/0129934 | A1 | 9/2002 | Mullins et al. | |
| 2006/0151181 | A1 | 7/2006 | Shahin | |
| 2008/0059073 | A1 * | 3/2008 | Giroux et al. | 702/9 |
| 2008/0099196 | A1 | 5/2008 | Latiolais et al. | |
| 2009/0200038 | A1 | 8/2009 | Swietlik et al. | |
| 2009/0205827 | A1 | 8/2009 | Swietlik et al. | |
| 2009/0205836 | A1 | 8/2009 | Swietlik et al. | |
| 2009/0205837 | A1 | 8/2009 | Swietlik et al. | |
| 2009/0229837 | A1 | 9/2009 | Wiens et al. | |
| 2009/0266532 | A1 | 10/2009 | Revheim et al. | |
| 2010/0032162 | A1 | 2/2010 | Olstad et al. | |
| 2010/0101805 | A1 | 4/2010 | Angelle et al. | |
| 2010/0206583 | A1 | 8/2010 | Swietlik et al. | |
| 2010/0206584 | A1 | 8/2010 | Clubb et al. | |
| 2011/0036586 | A1 | 2/2011 | Hart et al. | |

FOREIGN PATENT DOCUMENTS

| | | |
|---|---|---|
| WO | WO 96/07009 | 3/1996 |
| WO | WO-9607009 A2 | 3/1996 |
| WO | 9850672 | 11/1998 |
| WO | WO 00/47865 | 8/2000 |
| WO | WO 2007/108703 | 9/2007 |
| WO | WO 2007/144597 | 12/2007 |
| WO | WO-2009/114625 A2 | 9/2009 |

OTHER PUBLICATIONS

Top Drive Circulation Tool (TDCT) Brochure, Pilot Drilling Control Ltd., 2006, 5 pages.
Davis Fill and Circulate Tool, Davis-Lynch, LLC, 2005, 2 pages.
FCH Modelo C, Petronov, 2005, 4 pages.
FCH Modelo L, Petronova, 2005, 4 pages.
FCH Modelo S, Petronova, 2005, 7 pages.
PCT International Search Report and Written Opinion; International Application No. PCT/US2011/047145; Mailed Mar. 21, 2013.

* cited by examiner

FILL UP TOOL

CROSS-REFERENCE TO RELATED APPLICATIONS

This application claims benefit of U.S. Provisional Patent Application Ser. No. 61/401,193, filed Aug. 9, 2010; U.S. Provisional Patent Application Ser. No. 61/372,052, filed Aug. 9, 2010; and U.S. Provisional Patent Application Ser. No. 61/516,137, filed Mar. 30, 2011. Each of the aforementioned patent applications is incorporated herein by reference in its entirety.

BACKGROUND OF THE INVENTION

1. Field of the Invention

Embodiments of the present invention generally relate to running a casing into a wellbore. Particularly, embodiments of the present invention relate to a fill up tool for use during a casing running operation. More particularly, embodiments of the present invention relate to a fill up tool adapted to seal the casing for fill up or circulation of fluid during casing running operations.

2. Description of the Related Art

To obtain hydrocarbons from an earth formation, a wellbore is typically drilled to a predetermined depth using a drill string having a drill bit attached to its lower end. The drill string is then removed, and thereafter a casing is lowered into the wellbore to line the wellbore. The casing may be a casing section or, in the alternative, a casing string including two or more casing sections threadedly connected to one another.

While the casing is being lowered into the wellbore during the casing running operation, the pressure within the wellbore is typically higher than the pressure within the bore of the casing. This higher pressure within the wellbore exerts stress on the casing as it is being lowered into the wellbore, thereby risking damage or collapse of the casing during run-in. A casing fill-up operation is performed to mitigate these stresses. The casing fill-up operation involves filling the bore of the casing being run into the wellbore with a fluid (such as "mud") in an attempt to equalize the pressure inside the casing with the pressure outside the casing (i.e., the pressure within the wellbore) and thereby prevent collapse of the casing during the run-in operation. Pressurized fluid is typically input into the bore of the upper end of the casing using a fill line from the existing mud pumps at the well site.

At various times during the casing running operation, the casing may get stuck within the wellbore. To dislodge the casing from the wellbore, a circulating operation is performed by utilizing a circulation tool, where pressurized drilling fluid is circulated down the casing and out into the annulus to remove the obstructing debris. To "rig up" the circulating tool for circulating operation, the circulating tool is inserted into the bore of the casing at the upper end of the casing. A sealing member on the circulating tool is then activated to seal the circulating tool with the casing, forming a path for fluid flow through the circulating tool and out into the bore of the casing. Specifically, in a circulation operation, fluid is introduced into the circulating tool, flows through the bore of the casing and out the lower end of the casing to remove the obstructing debris, and then the fluid having the debris therein flows up the annulus to the surface of the wellbore.

After the circulation operation, the circulating tool is removed from the casing, and the casing fill-up operation is restarted to run casing into the wellbore. During the casing running and fill-up operations, air is allowed to escape through the bore of the casing to prevent over-pressurizing the bore of the casing. To vent the air from the bore of the casing, the circulating tool is removed from the casing prior to the fill-up operation. To remove the circulating tool, the sealing member is de-activated, and the circulating tool is lifted from the bore of the casing. The casing may then be lowered further into the wellbore while filling the casing with fluid to prevent collapse of the casing.

The casing running operation generally requires the sealing member on the fill up or circulation tool to be repeatedly inserted and removed from the interior of the casing. The constant movement of the sealing member against the wall of the casing over time may damage the integrity of the sealing member. In the respect, the sealing member's capacity to seal against a pressure kick in the wellbore is adversely affected.

There is, therefore, a need for a fill up tool suitable for fill up operations while maintaining capacity to seal against pressure fluctuations. There is also a need for a fill up tool having a sealing member arrangement capable of sealing against pressure fluctuation.

SUMMARY OF THE INVENTION

Embodiments of the present invention generally relate to a tool for use during tubular running operations. In one embodiment, a fill up tool includes a mandrel; a primary sealing member disposed on the mandrel; and a selectively operable secondary sealing member activatable by rotation of the mandrel.

In another embodiment, a fill up tool for use with a top drive includes a mandrel; a sealing member disposed around the mandrel; and a load transfer assembly configured to limit transfer of an upward force from the mandrel to the top drive. In yet another embodiment, the tool also includes an elevator coupled to the top drive, whereby the upward force is transferred to the elevator. In yet another embodiment, the tool includes a second sealing member selectively activatable by rotating the mandrel.

In another embodiment, a method of running casing includes providing a fill up tool equipped with a mandrel, a first sealing member, and a second sealing member; inserting the fill up tool into the casing; forming a first seal with the casing using the first sealing member; and activating the second sealing member by rotating the mandrel, thereby forming a second seal.

In another embodiment, a load transfer assembly for use with a top drive equipped with a tubular gripping apparatus and a tool connected to the top drive, includes a tubular connector interposed between the top drive and the tool; a load ring coupled to the tubular gripping apparatus; and a link for coupling the tubular connector to the load ring; whereby an upward force from the tool is transferred to the tubular gripping apparatus, thereby isolating the top drive from the upward force.

In another embodiment, a method of running casing includes providing a fill up tool equipped with a mandrel, a first sealing member, and a second sealing member; inserting the fill up tool into the casing; and forming a first seal with the casing using the first sealing member. In one embodiment, the method further comprises supplying fluid pressure to activate the second sealing member; and applying a compressive force to expand the second sealing member.

In another embodiment, a fill up tool includes a mandrel; a primary sealing member disposed around the mandrel; a secondary sealing member selectively activatable by hydraulic pressure; and a hydraulically operated actuator for applying a compressive force on the secondary sealing member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
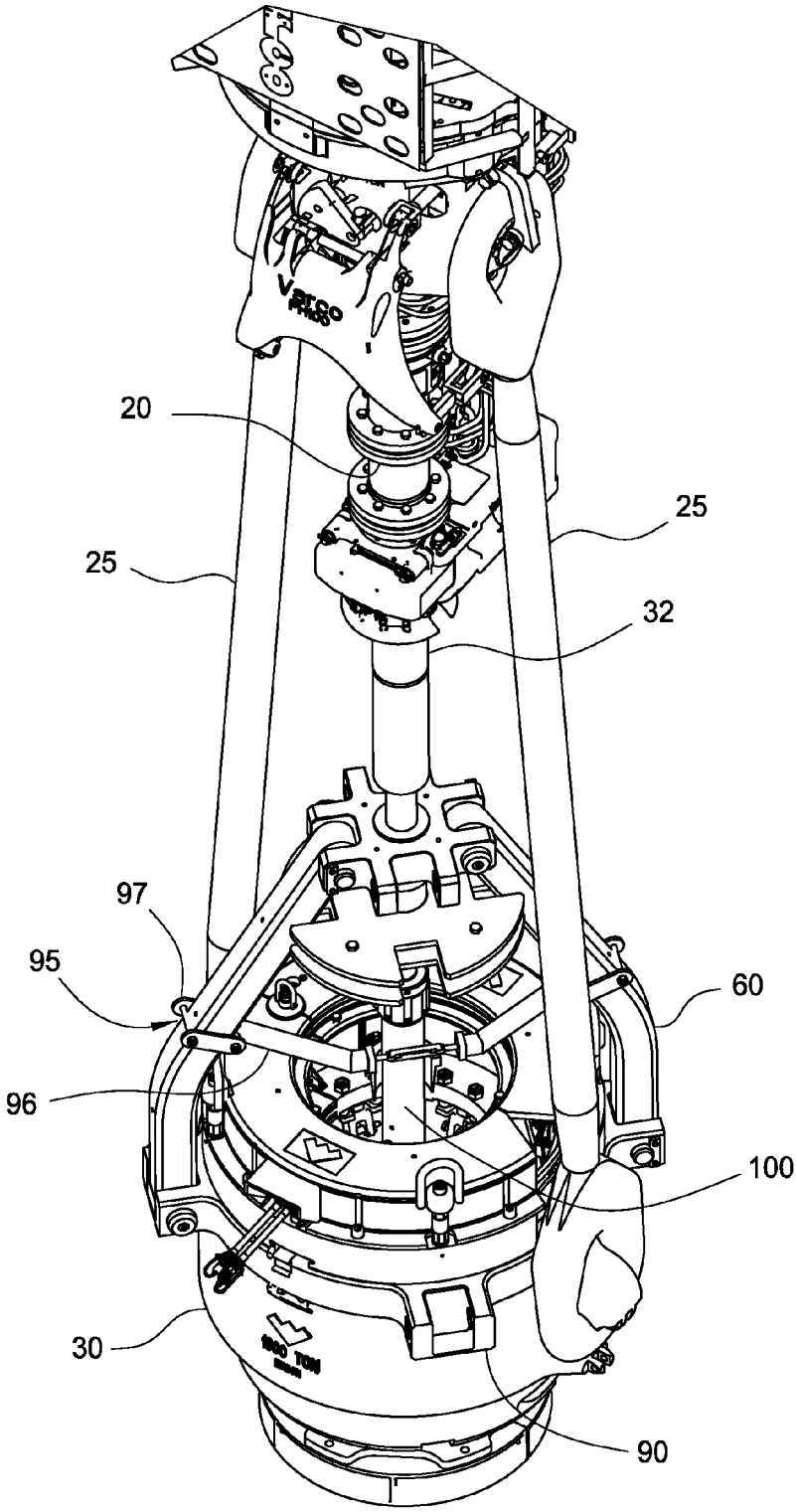
FIG. 1 is a view illustrating a fill up tool coupled to an elevator and a top drive according to one embodiment of the invention.
Figure 2:
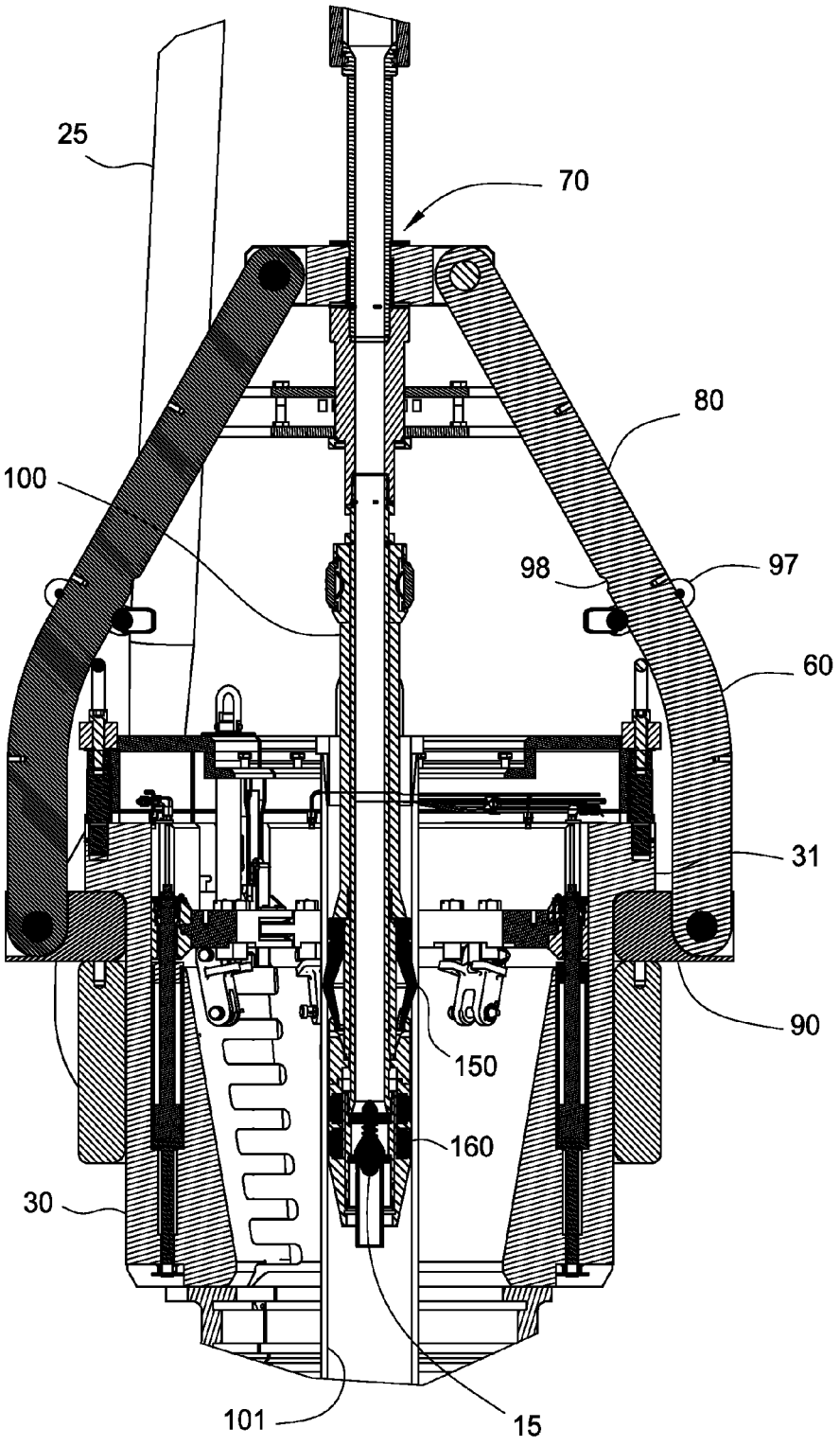
FIG. 2 is a cross-sectional view of the fill up tool and the elevator of FIG. 1.

FIG. 1 illustrates an embodiment of a fill up tool 100 coupled to an output shaft of a top drive 20 and coupled to an elevator 30. FIG. 2 is a cross-sectional view of the fill up tool 100 and the elevator 30. The fill up tool 100 extends into the elevator 30, which is supported by bails 25. A pup joint 32 may be provided to properly position the fill up tool 100 relative to the elevator 30. The fill up tool 100 is equipped with a load transfer assembly 60 to alleviate load applied to the top drive 20. An optional mudsaver valve 15 may be coupled the fill up tool 100. As shown in FIG. 2, the fill up tool 100 is partially disposed in the casing 101.

Figure 3:
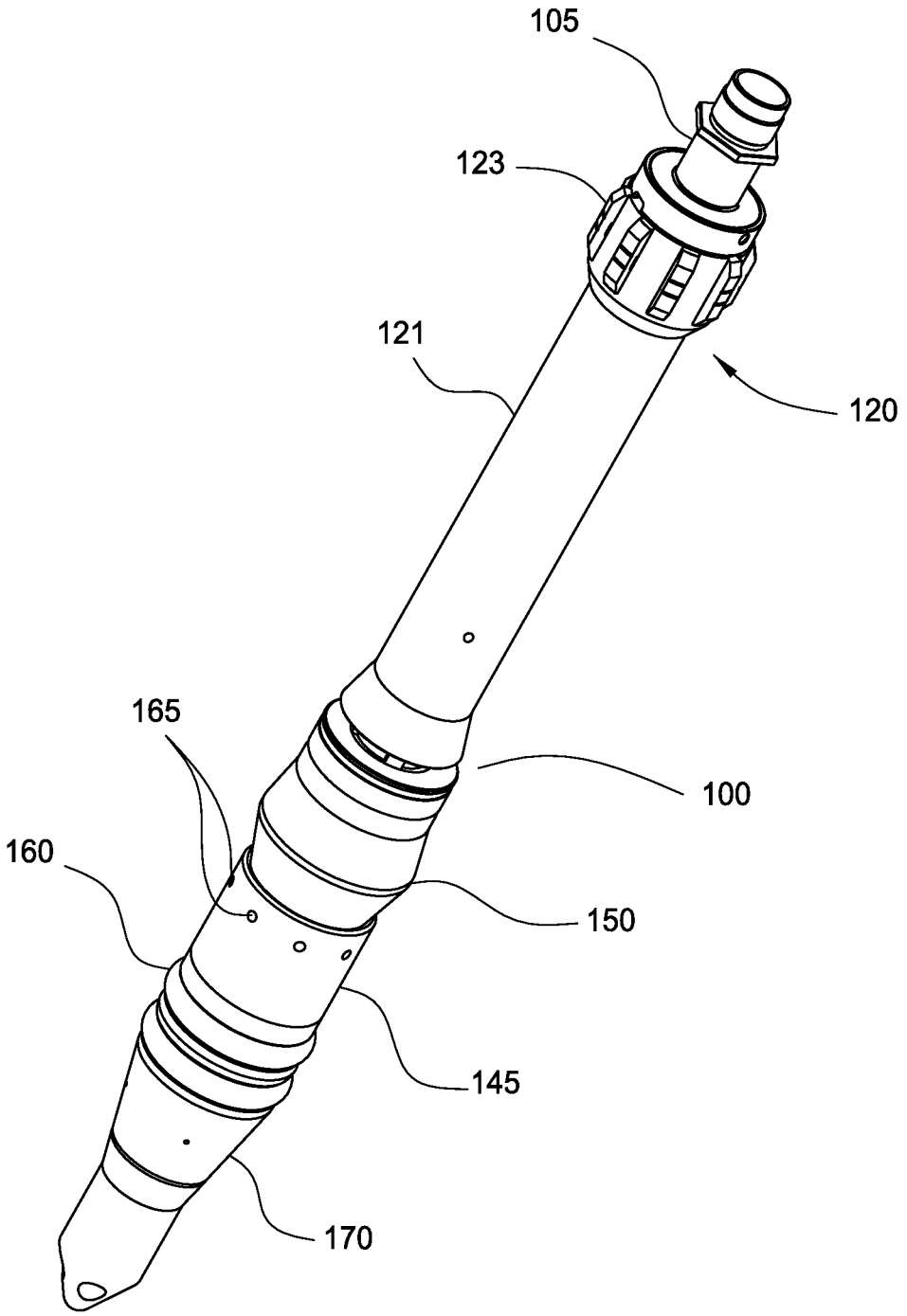
FIG. 3 is a perspective view of one embodiment of the fill up tool of FIG. 1.
Figure 4:
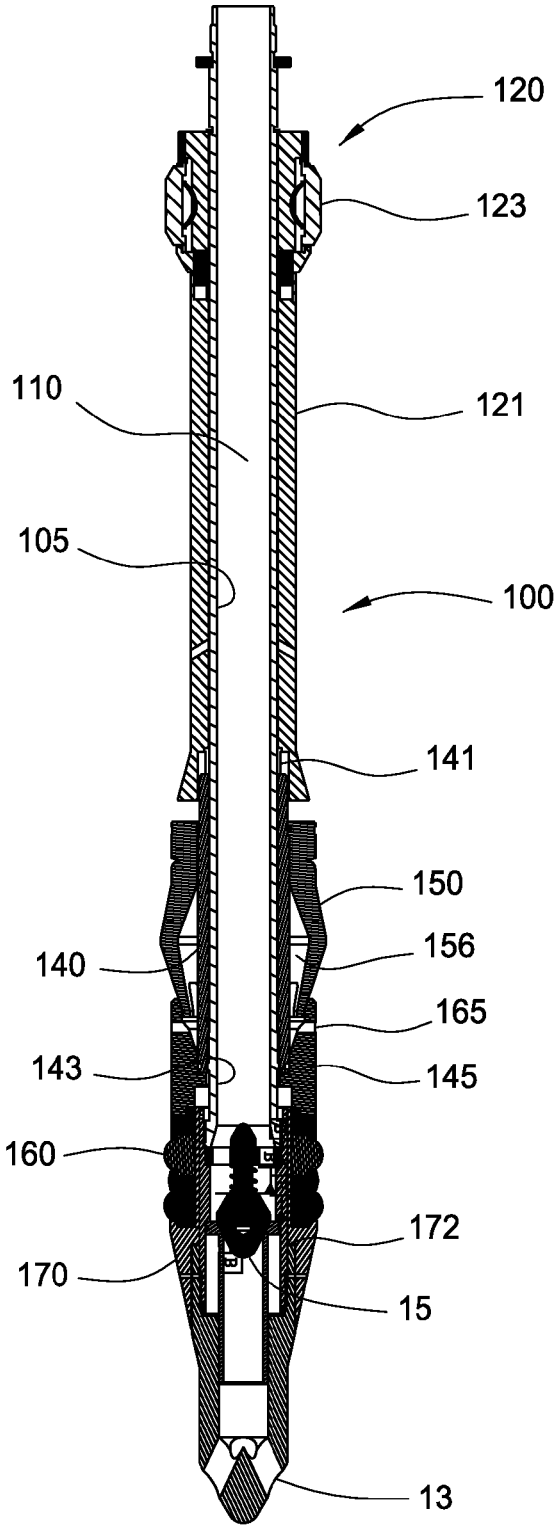
FIG. 4 is a cross-sectional view of the fill up tool of FIG. 3.

FIG. 3 is a perspective view of one embodiment of the fill up tool 100. FIG. 4 is a cross-sectional view of the fill up tool 100. The tool 100 is generally used to fill a casing string with fluid and/or circulate fluid through the casing string.

Referring to FIGS. 3-4, the tool 100 may include a mandrel 105, a sealing member 150, and a mudsaver valve assembly 15. The mandrel 105 extends through the sealing member 150 and connects to the mudsaver valve assembly 15. The mandrel 105 includes a bore 110 that is in fluid communication with the mudsaver valve assembly 15 to allow fluid to flow through the tool 100. Fluid may flow out of ports 13 at the lower end of the mudsaver valve assembly 15. In this embodiment, the valve of the valve assembly 15 is disposed inside the fill up tool 100. In another embodiment, the valve may be disposed below the fill up tool 100. The mandrel 105 also includes an upper portion that is configured to connect the tool 100 to a wellbore tool, such as the output shaft of a top drive or a casing clamping tool.

The tool 100 is equipped with an anti-rotation assembly 120 having a housing 121 and an engagement member 123. In one embodiment, the housing 121 is a tubular sleeve disposed around the mandrel 105 and is rotatable relative thereto. The engagement member 123 is adapted to engage the casing, thereby preventing the housing 121 from rotating with respect to the casing. An exemplary engagement member 123 is a drag block biased outwardly from the housing 121 using a bias member such as a spring. A plurality of drag blocks 123 may be disposed circumferentially around the exterior of the housing 121 to engage the casing.

An actuator 140 is coupled to the lower end of the housing 121. In one embodiment, the actuator 140 comprises a sleeve having a splined upper end for coupling with a splined lower end of the housing 121. The spline coupling 141 allows the actuator 140 to move axially relative to the housing 121 while rotationally fixed relative to the housing 121. The inner surface of the actuator 140 includes threads 143 for coupling to the mating threads on the outer surface of the mandrel 105. The lower end of the actuator 140 is connected to a compression sleeve 145 that is movable with the actuator 140. In another embodiment, the actuator 140 and the compression sleeve 145 are integrated as one unit.

As shown, the sealing member 150 is disposed around the outer surface of the actuator 140. In this respect, the outer diameter of the actuator 140 is smaller than the anti-rotation housing 121 and/or the compression sleeve 145. The lower end of the sealing member 150 may be inserted into or surrounded by the compression sleeve 145. Exemplary sealing members include a packer such as a cup packer or other elastomeric packers. In one embodiment, the geometry of the sealing member 150 is designed to form an interference fit between an inner diameter of the casing and an outer diameter of the sealing member 150. The sealing member 150 has an upper end that is sealed against the mandrel 105 and a lower end having an opening for access to an inner void 156 in the sealing member 150. In another embodiment, the outer diameter of the lower end of the sealing member 150 is smaller than an inner diameter of the surrounding casing. Further, an outer diameter above the lower end is sufficiently sized to engage the inner diameter of the surrounding casing. In one embodiment, sealing member 150 is a dual durometer elastomer packer. In another embodiment, a lower portion of the sealing member 150 is made of a material that is harder than an upper portion of the sealing member 150. An exemplary sealing member is disclosed in U.S. Patent Application Publication No. 2010/0032162, entitled "Fill Up and Circulation Tool and Mudsaver Valve," which application is incorporated herein by reference in its entirety, including the description related to the packer assembly.

Internal pressure increase caused by air or drilling fluid may be used to energize the sealing member 150 into tight engagement with the inner diameter of the casing. As shown in FIGS. 3-4, the sealing member 150 may include a plurality of ports 165 formed through the upper end of the compression sleeve 145. The ports 165 are configured as fluid pathways into the inner void 156 of the sealing member 150, whereby fluid from the exterior of the sealing member 150 may be communicated through the ports 165 and into the inner void 156. The sealing member 150 is energized when sufficient pressure supplied into the inner void 156.

The tool 100 may further include a secondary sealing member 160 that is selectively operable. In one embodiment, the secondary sealing member 160 comprises an elastomeric material retained between the compression sleeve 145 and a guide sleeve 170. The secondary sealing member 160 is disposed on an extended, smaller diameter portion of the guide sleeve 170. In one embodiment, the outer diameter of the guide sleeve 170 is larger than the outer diameter of secondary sealing member 160 in the un-activated state. The inner diameter of the guide sleeve 170 may be provided with a protrusion 172 for contact and outward shoulder of the mandrel 105 to prevent downward movement of the guide sleeve 170 relative to the mandrel 105. Also, the guide sleeve 170 allows relative rotation with the mandrel 105 such that the secondary sealing member 160 cannot rotate after being energized. An optional anti-friction device such as a polytetrafluoroethylene washer may be disposed between the guide sleeve 170 and the mandrel 105 to facilitate relative rotation therebetween. In an alternative embodiment, the secondary sealing packer 160 is disposed directly on the mandrel 105.

In another embodiment, an optional connection device may be provided at the lower end of the mandrel 105. The connection device may be used to facilitate connection to other tools such as a mud hose, a pup joint, a mudsaver valve, or other suitable tool. An exemplary mudsaver valve is disclosed in U.S. Patent Application Publication No. 2010/0032162, entitled "Fill Up and Circulation Tool and Mudsaver Valve," which application is incorporated herein by reference in its entirety, including the description related to the mudsaver valve and FIGS. 2-4.

In operation, fill up tool 100 is connected to a lower end of the top drive output shaft or to a tubular gripping tool connected to the output shaft. The fill up tool 100 is inserted into a casing, which may be held by slips in the rig floor. After insertion, the sealing member 150 engages the inner diameter casing to provide a seal to prevent fluid from leaking out of the top of the casing. The sealing member 150 may be energized by air or fluid in the casing. During normal operation, the drag block 123 may remain outside of the casing.

Loom In the event of an unexpected increase in pressure in the casing, such as during a pressure kick, the secondary sealing member 160 may be activated to provide an additional seal in the casing. To activate the secondary sealing member 160, the fill up tool 100 is inserted further into the casing until the drag blocks 123 are inside the casing and engaged to the casing. Due to the biasing force exerted on the drag blocks 123, the drag blocks 123 retain the housing 121 in a rotationally fixed position relative to the casing. In this respect, rotation of the mandrel 105 is relative to the housing 121 and the actuator 140. In turn, the sealing member 150 is prevented from rotation, thereby minimizing wear against the casing. Rotation of the mandrel 105 causes its threads to rotate relative to the mating threads 143 on the actuator 140. Because actuator 140 is coupled to the housing 121 using the spline connection 141 and the housing 121 is rotationally fixed, rotation of the mandrel 105 causes axial movement of the actuator 140 relative to the housing 121. The actuator 140 also moves axially relative to the guide sleeve 170, which cannot move downwardly relative to the mandrel 105. The actuator 140 moves the compressive sleeve 145 toward the guide sleeve 170, thereby applying a compressive force on the secondary sealing member 160. In this respect, the secondary sealing member 160 is "squeezed" outwardly into contact with the casing to form a secondary seal against the pressure kick. The secondary sealing member provides a sufficiently robust seal to contain the increased pressure in the well. In some instances, fluid may be supplied through the fill up tool 100 to control the well. Additionally, the casing string may be picked up and/or rotated to control the well. In this manner, the sealing capacity of the secondary sealing member 160 is preserved to ensure a proper seal in response to pressure fluctuations.

Figure 5:
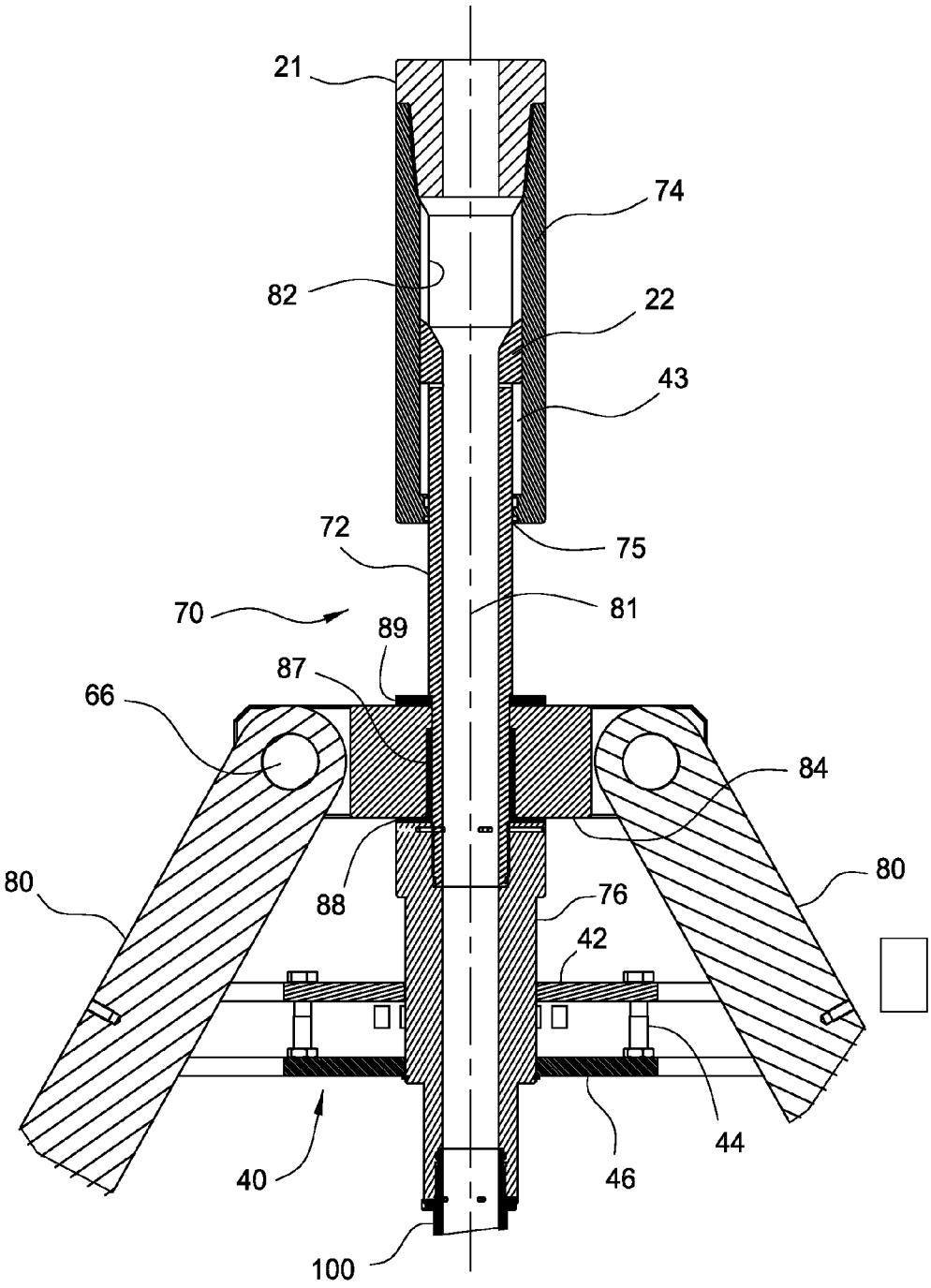
FIG. 5 illustrates a partial cross-sectional view of an embodiment of the slip joint assembly.

In some operations, a pressure increase in the well may generate an upward force on the output shaft when one or both of the sealing assemblies 150, 160 are energized. To limit the effect of the upward force on the output shaft, the fill up tool 100 may be equipped with a load transfer assembly 60 as shown in FIGS. 1 and 2. In FIG. 2, the load transfer assembly 60 includes a slip joint assembly 70, links 80 connected to the slip joint 70 and the elevator 30, and a load ring 90. FIG. 5 shows a partial cross-sectional view of an embodiment of a slip joint assembly 70 of a load transfer assembly 60. The load transfer assembly may be used with any fill up tool disclosed herein or any suitable fill up tool known to a person of ordinary skill in the art. FIG. 5 shows only the top portion of the mandrel of the fill up tool 100 connected to the slip joint assembly 70. The slip joint assembly 70 includes a connection shaft 72 coupled to a connection housing 74. The upper end of the connection housing 74 may be connected to the output shaft 21 of the top drive 20. The upper end of the connection shaft 72 is at least partially disposed in the connection housing 74. In one embodiment, a key 22 provided on the outer surface of the connection shaft 72 is coupled to the keyway 43 on the connection housing 74. The key and keyway connection 22, 43 allows relative axial movement and transfer of torque from the connection housing 74 to the connection shaft 72. In one embodiment, the connection housing 74 includes an axial gap 82 between the upper end of the connection shaft 72 and the interior upper portion of the connection housing 74. The axial gap 82 is preferably sufficiently large to prevent the upper end of the connection shaft 72 from contacting the upper portion of the connection housing 74 when an upward force is applied to the fill up tool 100. A connection adapter 76 is connected to the lower end of the connection shaft 72. In turn, the fill up tool 100 is connected to the upper end of the connection adapter 76. The housing 74, shaft 72, and adapter 76 are configured with a bore 81 for allowing fluid communication from the output shaft 21 to the fill up tool 100. One of more seals 75 such as o-ring seals may be disposed between the connection shaft 72 and the connection housing 74 to prevent fluid leakage therebetween.

In one embodiment, the upper portion of the connection adapter 76 has a larger outer diameter than the outer diameter of the connection shaft 72. Link plates 84 or other suitable connectors may be provided around the connection shaft 72 and above the connection adapter 76. The connection shaft 72 may have a tubular shaped body. A bearing 87 may be disposed between the connection shaft 72 and the link plates 84 to facilitate rotation therebetween. Optional bearings 88, 89 may be disposed above and below the link plates 84.

The link plates 84 are coupled to the upper end of the links 80. In one example, a pin 66 may be inserted through the link plates 84 and the elevator link 80 to provide a pivotable connection. The lower end of the links 80 is coupled to the load ring 90. Pins may similarly be used to couple the links 80 to the load ring 90. The links 80 may be rigid or flexible, and may have circular or polygonal cross-section. Any suitable number of links may be used, for example, two, three, four, or more links. The load ring 90 may be disposed below the flange 37 at the upper portion of the elevator 30, or other suitable location such as above the lift adapter, whereby axial load may be transferred between the load ring 90 and the elevator 30.

A bumper assembly 40 is optionally provided to limit insertion depth of the fill up tool in the casing. The bumper assembly 40 is attached between the load transfer assembly and the fill up tool 100. The bumper assembly 40 includes a base ring 42 having one or more holes for receiving a screw 44 and an engagement plate 46 positioned below the screws. The engagement plate 46 limits the insertion distance of the fill up tool inside the casing. In the event the casing is set too close to the engagement plate and cannot move axially upward to release from a slip, the screws 44 may be released to allow axial movement of the plate 46 relative to the casing.

In operation, when a pressure increase in the well generates an upward force on the fill up tool 100, the upward force is transferred to the connection adapter 76. In turn, the upward force is transferred to the link plates 84, the links 80, the load ring 90, and then the elevator 30. The upward force on the elevator 30 is countered by the downward force from the weight of the casing string. In this respect, the upward movement of the connection shaft 72 is limited by the length of the links 80. Moreover, because of the axial gap 82, the connection shaft 72 cannot transfer the upward force to the connection housing 74. In this manner, the output shaft of the top drive is substantially isolated from the upward force created by the pressure increase.

A bracket 95 may be provided to facilitate installation and/or transport of the load transfer assembly 60, as shown in FIGS. 1 and 2. The bracket includes an extendable arm 96 having ends coupled to the transfer links 80. In one embodiment, the ends may have latches 97 around the transfer links 80. One or more notches 98 to may be formed on the links 80 for receiving the bracket 95. The central portion of the extendable arm 96 may be curved to allow use with the fill up tool. In this respect, the bracket 95 may remained coupled to the links 80 or removed therefrom after transport or installation or during operation. The arms 96 may be extended or retracted to facilitate alignment of the links 80 to the load ring 90 for coupling.

Figure 6:
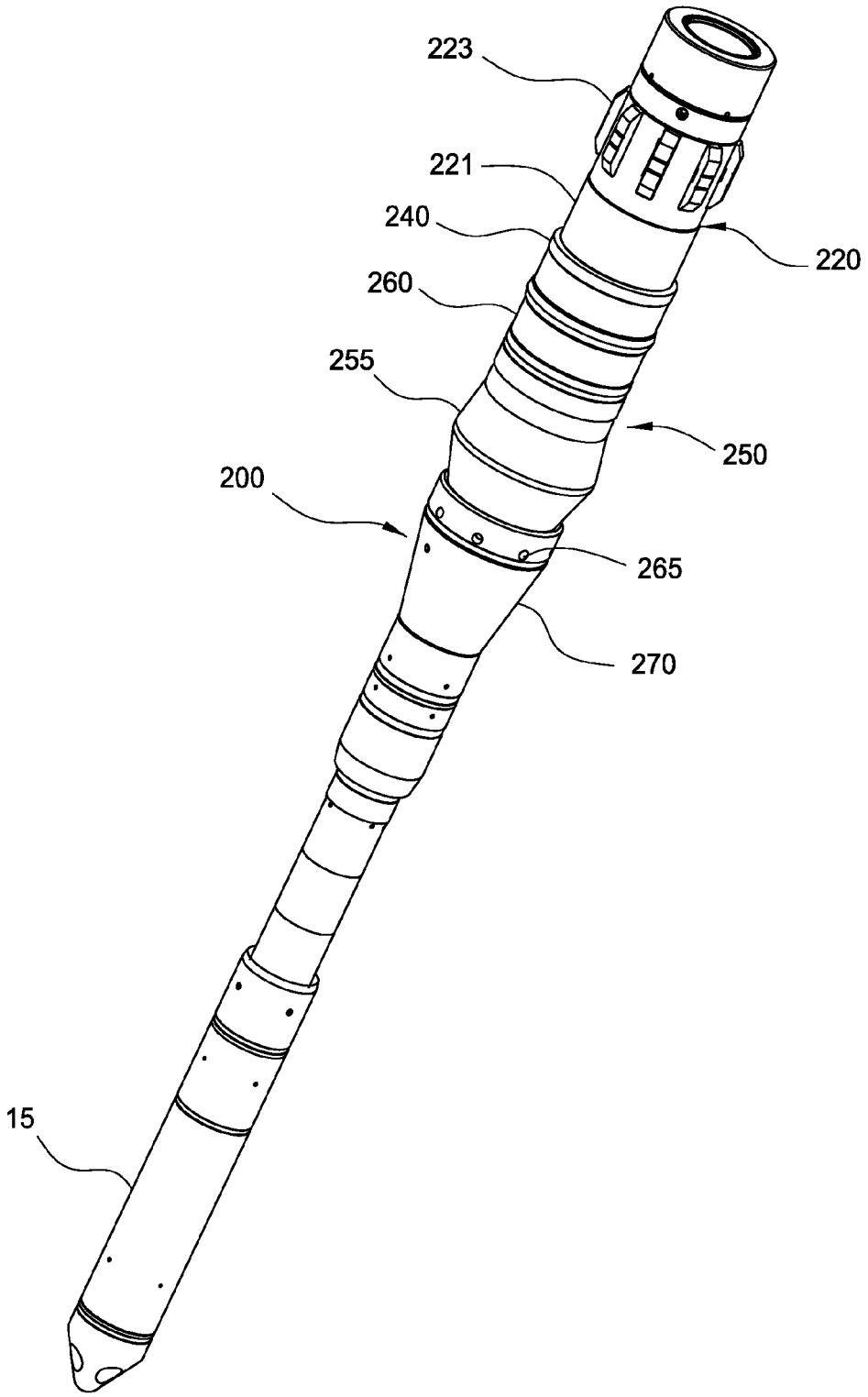
FIG. 6 is a perspective view of another embodiment of the fill up tool.
Figure 7:
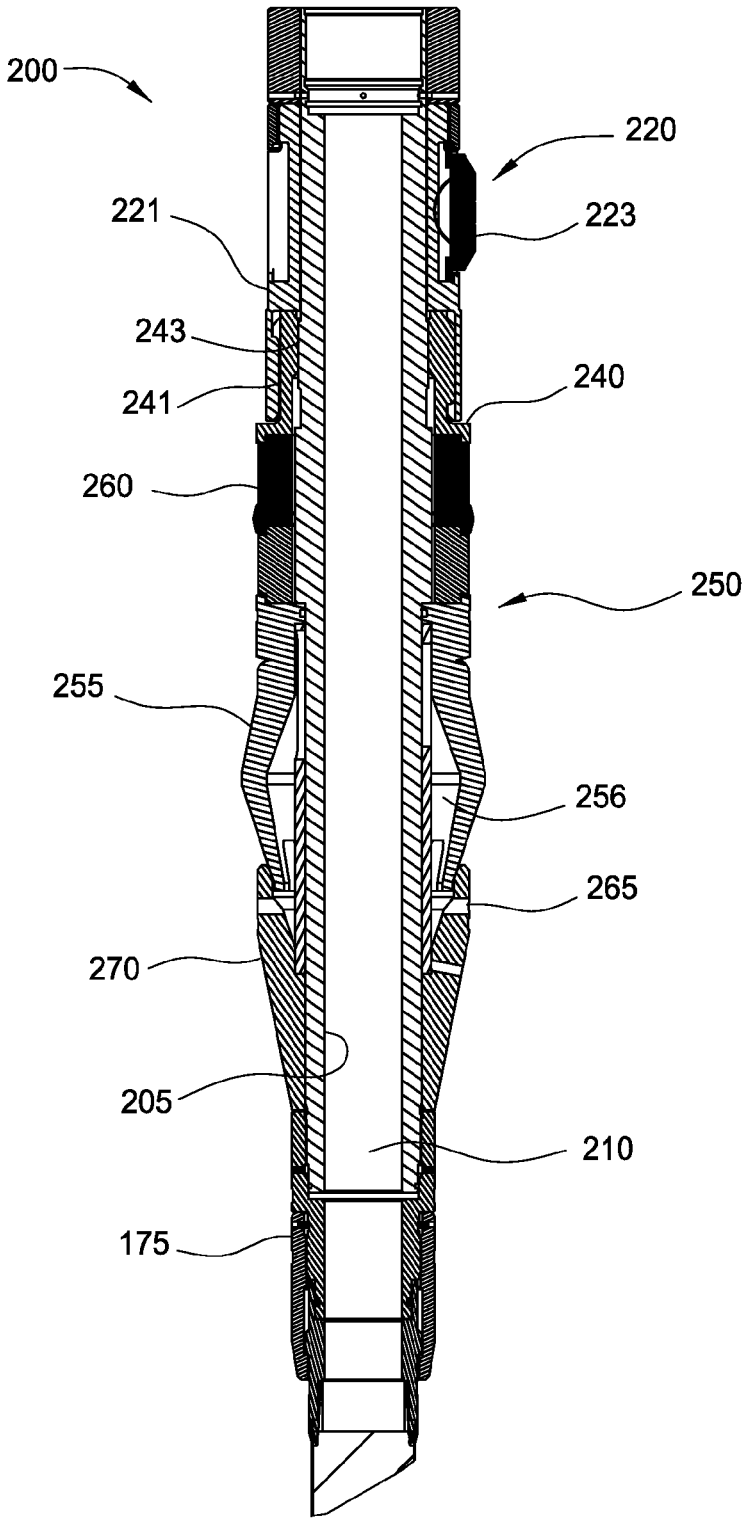
FIG. 7 is a cross-sectional view of the fill up tool of FIG. 6.

FIGS. 6 and 7 illustrate another embodiment of a fill up tool 200. FIG. 6 is a perspective view of the fill up tool 200, and FIG. 7 is a cross-sectional view of the tool 200. The tool 200 may include a mandrel 205, a seal assembly 250, and a mudsaver valve assembly 15. The mandrel 205 extends through the seal assembly 250 and connects to the mudsaver valve assembly 15. The mandrel 205 includes a bore 210 that is in fluid communication with the mudsaver valve assembly 15 to allow fluid to flow through the tool 200. The mandrel 205 also includes an upper portion that is configured to connect the tool 200 to a wellbore tool, such as the output shaft of a top drive or a casing clamping tool.

The tool 200 is equipped with an anti-rotation assembly 220 having a housing 221 and an engagement member 223, that are substantially similar to the anti-rotation assembly 120 of FIG. 3. An actuator 240 is coupled to the lower end of the housing 221 using a spline coupling 241, which allows the actuator 240 to move axially relative to the housing 221 while rotationally fixed relative to the housing 221. The inner surface of the actuator 240 includes threads 243 for coupling to the mating threads on the outer surface of the mandrel 205. The lower end of the actuator 240 is configured to retain the seal assembly 250 and apply a compressive force to the seal assembly 250.

As shown, the seal assembly 250 includes a primary sealing member 255 and a secondary sealing member 260. The primary sealing member 255 is disposed around the outer surface of the mandrel 205. In one embodiment, the geometry of the primary sealing member 255 is designed to form an interference fit between an inner diameter of the casing and an outer diameter of the primary sealing member 255. The primary sealing member 255 has an upper end that is sealed and fixed against the mandrel 205 and a lower end having an opening for access to an inner void 256 in the primary sealing member 255. An exemplary primary sealing member 255 is a cup seal.

The secondary sealing member 260 is disposed directly above and in contact with the primary sealing member 255 and below the actuator 240. During operation, the sealing member 260 is selectively actuatable upon compression between the primary sealing member 255 and the actuator 240. In one embodiment, the outer diameter of the primary sealing member 255 is larger than the outer diameter of secondary sealing member 260 in the un-activated state.

The lower end of the primary sealing member 255 may be inserted into or surrounded by the guide sleeve 270. As shown in FIGS. 6-7, the guide sleeve 270 may include a plurality of ports 265 configured as fluid pathways into the inner void 256 of the primary sealing member 255, whereby fluid from the exterior of the sealing member 250 may be communicated through the ports 265 and into the inner void 256. Internal pressure increase caused by air or drilling fluid energizes the primary sealing member 255 into tight engagement with the inner diameter of the casing. The primary sealing member 255 is energized when sufficient pressure is supplied into the inner void 256. The lower end of the mandrel 205 may include a connection device used to facilitate connection to other tools such as a mud hose, a pup joint, a mudsaver valve, or other suitable tool.

In operation, fill up tool 200 is connected to a lower end of the top drive output shaft or to a tubular gripping tool connected to the output shaft. The fill up tool 200 is inserted into a casing, which may be held by slips in the rig floor. After insertion, the primary sealing member 255 engages the inner diameter casing to provide a seal to prevent fluid from leaking out of the top of the casing. The primary sealing member 255 may be energized by air or fluid in the casing. During normal operation, the drag block 223 may remain outside of the casing.

In the event of a pressure kick, the secondary sealing member 260 may be activated to provide an additional seal in the casing. The fill up tool 200 is inserted further into the casing until the drag blocks 223 are inside the casing and engaged to the casing. Due to the biasing force exerted on the drag blocks 223, the drag blocks 223 retain the housing 221 rotationally fixed relative to the casing. The mandrel 205 is then rotated relative to the housing 221 and the actuator 240. The threads on the mandrel 205 rotate relative to the mating threads 243 on the actuator 240. Because actuator 240 is coupled to the housing 221 using a spline connection 241 and the housing 221 is rotationally fixed, rotation of the mandrel 205 causes axial movement of the actuator 240 relative to the housing 221. The actuator 240 also moves axially relative to the primary sealing member 255, which is fixed to the mandrel 205. In this respect, the actuator 240 applies a compressive force on the secondary sealing member 260 against the primary sealing member 255, thereby squeezing the secondary sealing member 260 outwardly into contact with the casing to form a secondary seal against the pressure kick. The secondary sealing member provides a sufficiently robust seal to contain the increased pressure in the well. In some instances, fluid may be supplied through the fill up tool 200 to control the well.

Figure 8:
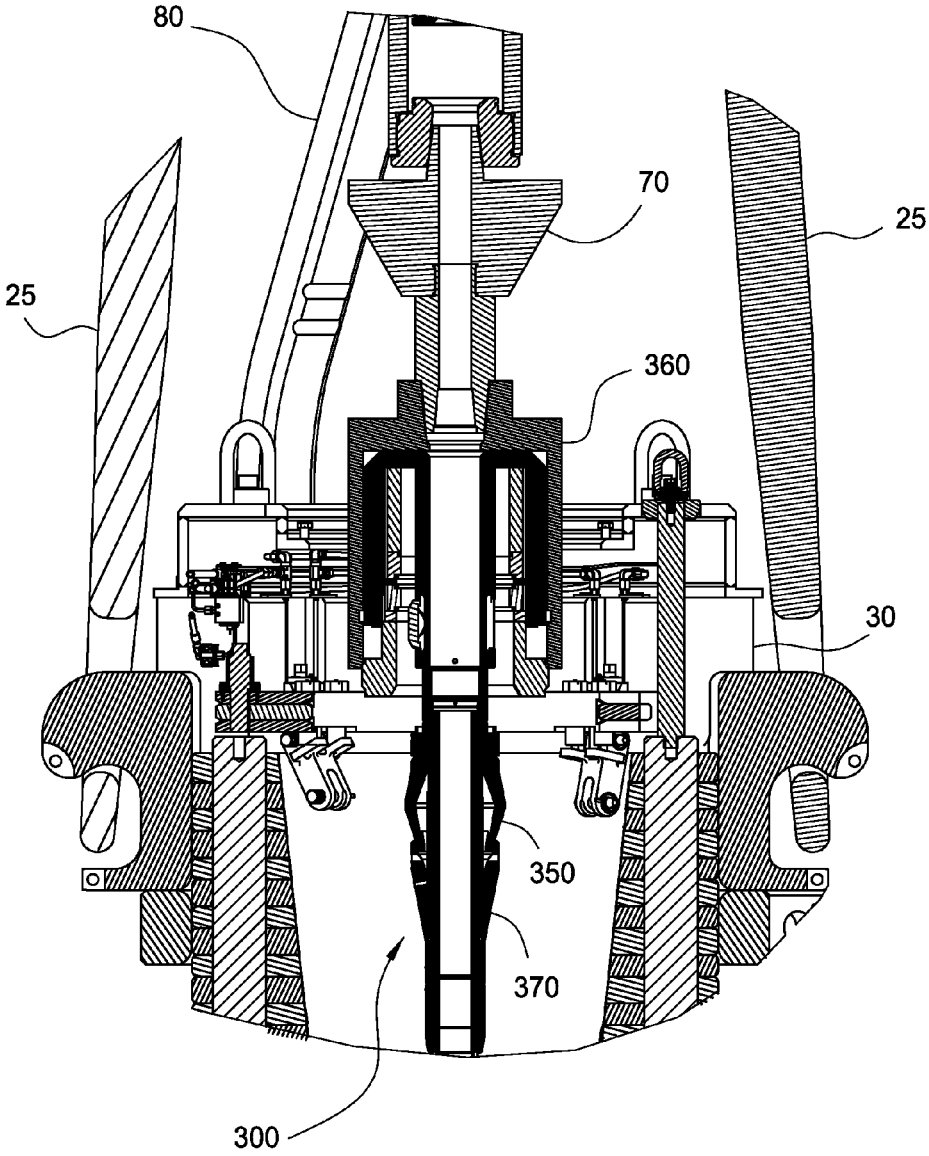
FIG. 8 is a partial cross-sectional view of another embodiment of the fill up tool.
Figure 9:
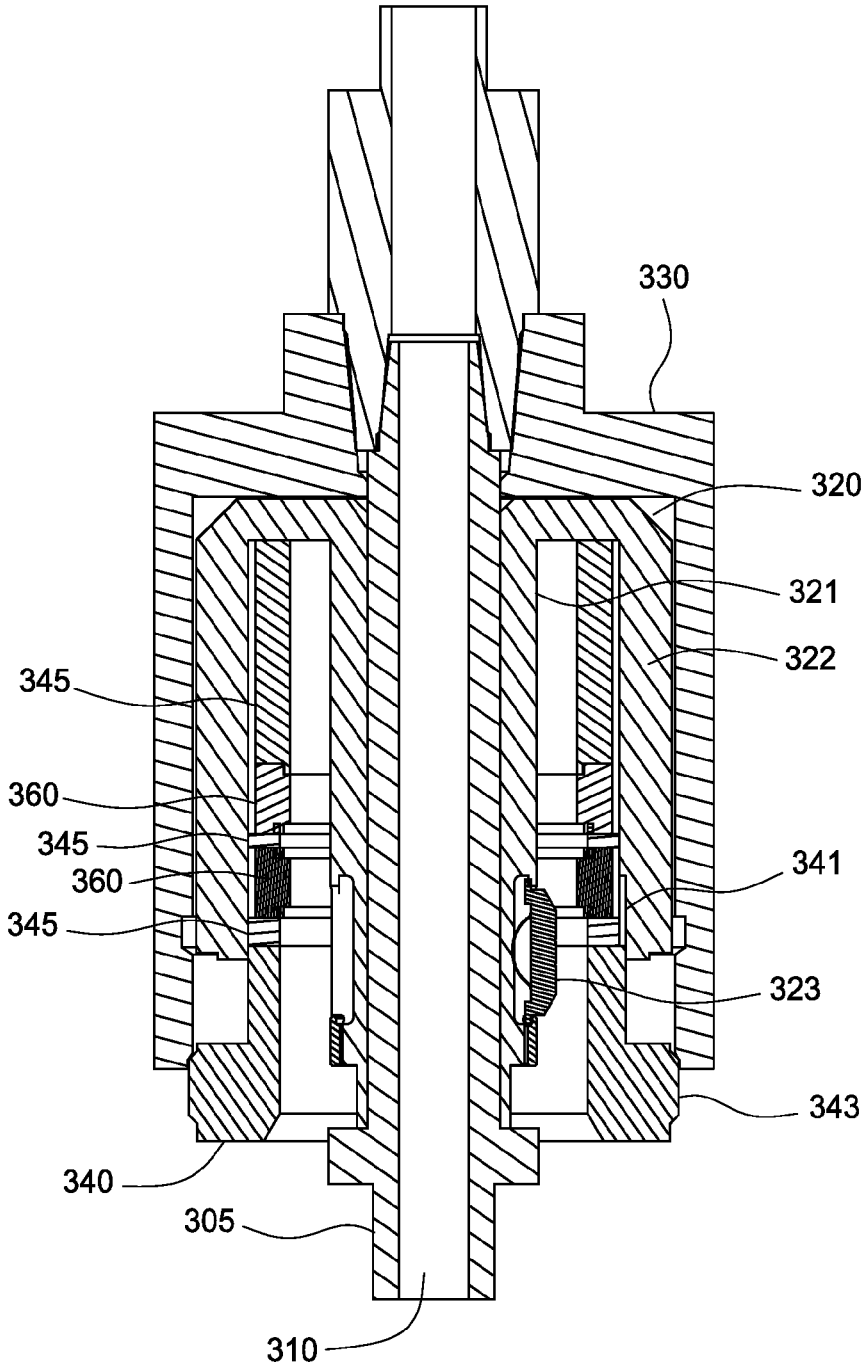
FIG. 9 is an enlarged view of the secondary sealing member of the fill up tool of FIG. 8.

FIGS. 8 and 9 illustrate another embodiment of a fill up tool 300 connected to an output shaft of a top drive 20. The fill up tool 300 extends into an elevator 30 supported by bails 25. The fill up tool 300 is equipped with a secondary sealing member 360 configured to seal an outer diameter of the casing. An optional mudsaver valve connected to the fill up tool 300. FIG. 8 is a partial cross-sectional view of the fill up tool 300 with the elevator 30. FIG. 9 is an enlarged partial view of the fill up tool 300.

The fill up tool 300 may include a mandrel 305, a primary sealing member 350, a secondary sealing member 360, and a mudsaver valve assembly. The mandrel 305 extends through the sealing members 350, 360 and connects to the mudsaver valve assembly. The mandrel 305 includes a bore 310 that is in fluid communication with the mudsaver valve assembly to allow fluid to flow through the tool 300. The mandrel 305 also includes an upper portion that is configured to connect the tool 300 to a wellbore tool, such as the output shaft of a top drive or a casing clamping tool.

The tool 300 is equipped with an anti-rotation assembly 320 disposed within a rotatable housing 330. The anti-rotation assembly includes an inner housing 321 connected to an outer housing 322, whereby an annular area is defined therebetween. The inner and outer housings 321, 322 are rotatable relative to the mandrel 305 and the rotatable housing 330. An engagement member 323 is disposed on the inner housing 321 and is biased toward the annular area. The engagement member 323 is adapted to engage the inner surface of the casing, thereby preventing the inner and outer housings 321, 322 from rotating with respect to the casing. An exemplary engagement member 323 is a drag block biased outwardly from the inner housing 321 using a bias member such as a spring. A plurality of drag blocks 323 may be disposed circumferentially around the exterior of the inner housing 321 to engage the casing.

An actuator 340 is coupled to the inner surface of the outer housing 322. In one embodiment, the actuator 340 comprises a sleeve having a splined upper end for coupling with a splined lower end of the outer housing 322. The spline coupling 341 allows the actuator 340 to move axially relative to the outer housing 322 while rotationally fixed relative to the outer housing 322. The inner diameter of the actuator 340 dimensioned to receive the casing between the actuator 340 and the inner housing 321. The lower end of the actuator includes an enlarged portion for engagement with the rotatable housing 330. In one embodiment, a threaded connection 343 is used couple the actuator 340 to the rotatable housing 330.

The secondary sealing member 360 is disposed in the annular area and above the actuator 340. The secondary sealing member 360 may be disposed between a plurality of compressive sleeves 345. As shown, two secondary sealing members 360 are provided between three compressive sleeves 345. It must be noted that any suitable number and combination of sealing members 360 and sleeves 345 may be used. Similar to the actuator 340, the inner diameter of the sealing members 360 and the compressive sleeves 345 is dimensioned to accommodate the casing between the secondary sealing members 360 and the inner housing 321. The lower compressive sleeve 345 is in contact with the upper end of the actuator 340 to transfer a compressive force to the secondary sealing members 360.

The primary sealing member 350 is disposed around the outer surface of the mandrel 305. In one embodiment, the geometry of the primary sealing member 350 is designed to form an interference fit between an inner diameter of the casing and an outer diameter of the primary sealing member 350. An exemplary primary sealing member 355 is a cup seal. The lower end of the primary sealing member 350 may be inserted into or surrounded by the guide sleeve 370. The primary sealing member 350 and the guide sleeve 370 are substantially similar to those described with respect to FIGS. 6 and 7, and thus, its design and operation will not be further described in detail. The lower end of the mandrel 305 may include a connection device used to facilitate connection to other tools such as a mud hose, a pup joint, a mudsaver valve, or other suitable tool In operation, fill up tool 300 is connected to a lower end of the top drive output shaft or to a tubular gripping tool connected to the output shaft. The fill up tool 300 is inserted into a casing, which may be held by slips in the rig floor. After insertion, the primary sealing member 350 engages the inner diameter casing to provide a seal to prevent fluid from leaking out of the top of the casing. The primary sealing member 350 may be energized by air or fluid in the casing. During normal operation, the drag block 323 may remain outside of the casing.

In the event of a pressure kick, the secondary sealing member 360 may be activated to provide an additional seal in the casing. The fill up tool 300 is inserted further into the casing until the drag blocks 323 are inside the casing and engaged to the casing, and until the upper end of the casing is above the secondary sealing members 360. Due to the biasing force exerted on the drag blocks 323, the drag blocks 323 retain the inner and outer housings 321, 322 rotationally fixed relative to the casing. The mandrel 305 is then rotated, which also rotates the rotatable housing 330, relative to the inner and outer housings 321, 322. The threads on the rotatable housing 330 also rotate relative to the mating threads 343 on the actuator 340. Because actuator 340 is coupled to the outer housing 322 via the spline connection 341 and the outer housing 322 is rotationally fixed, rotation of the rotatable housing 330 causes axial movement of the actuator 340 relative to the outer housing 322. The axial movement of actuator 340 applies a compressive force on the secondary sealing members 360 against the compressive sleeves 345, thereby squeezing the secondary sealing members 360 into contact with the outer surface of the casing to form a secondary seal against the pressure kick. The secondary sealing members 360 provide a sufficiently robust seal to contain the increased pressure in the well. In some instances, fluid may be supplied through the fill up tool 300 to control the well.

Figure 10:
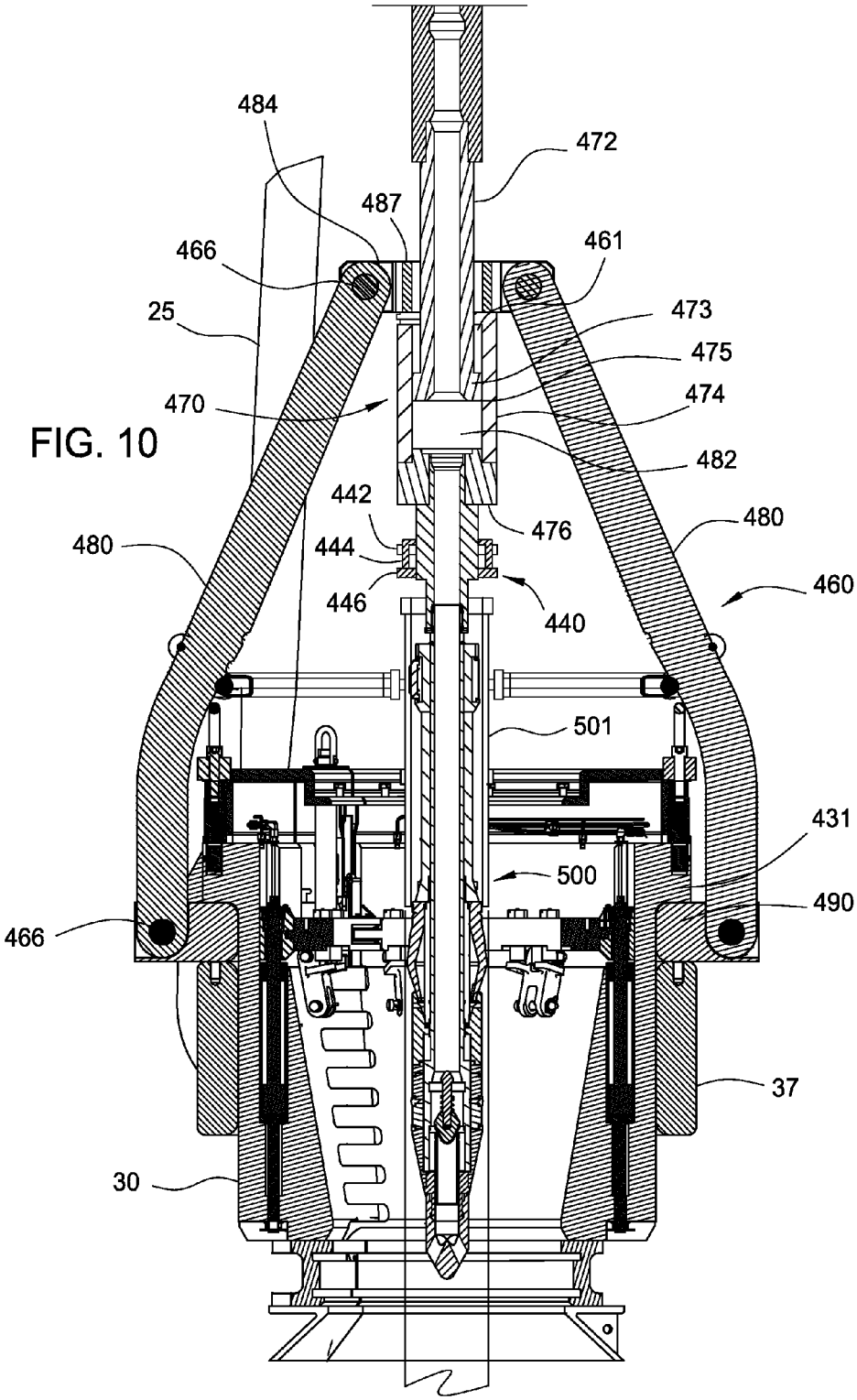
FIG. 10 illustrates another embodiment of a load transfer assembly.

FIG. 10 illustrate another embodiment of a load transfer assembly 460. FIG. 10 is a cross-sectional view of the load transfer assembly 460. The load transfer assembly 460 may be used with any fill up tool disclosed herein or any suitable fill up tool known to a person of ordinary skill in the art. The fill up tool 500 is shown disposed inside the casing 501, which is only partially shown. The fill up tool may be also referred to herein as a casing well control tool ("CWCT"). In FIG. 10, the load transfer assembly 460 includes a slip joint assembly 470, links 480 to the elevator 30, and a load ring 490. The slip joint assembly 470 includes a connection shaft 472 coupled to a connection housing 474. The upper end of the connection shaft 472 may connect to the output shaft of the top drive. The lower end of the connection shaft 472 includes a shoulder 473 configured to sealingly engage the interior the connection housing 474. The outer diameter of the connection shaft 472 may have a polygonal cross-section that mates with a correspondingly a shaped opening of the connection housing 474, whereby the connection shaft 472 is axially movable relative to the connection housing 474, while rotationally fixed relative to the connection housing 474. The polygonal shaped connection allows the connection shaft 472 to transfer torque to the connection housing 474 for rotation. For example, the shaft 472 may have a square cross-section that mates with the square opening of the housing 474. During operation, a gap 461 may exist between the upper surface of the shoulder 473 and the upper portion of the housing 474. One of more seals 475 such as o-ring seals may be disposed between the connection shaft 472 and the connection housing 474 to prevent fluid leakage therebetween.

A connection adapter 476 attached to the lower end of the connection housing 474 may be used to connect the slip joint 470 to the fill up tool 500. The connection adapter 476 may be attached to the connection housing 474 using a threaded connection. In one embodiment, connection adapter 476 is configured such that an axial gap 482 exists between the connection adapter 476 and the lower end of the connection shaft 472. The axial gap 482 is preferably sufficiently large to prevent contact with connection shaft 472 when an upward force is applied to the fill up tool 500.

Link plates 484 or other suitable connectors may be provided around the connection housing 474. A bearing 487 may be disposed between the outer surface of the connection housing 474 and the link plates 484 for relative rotation therebetween. The link plates 484 are coupled to the upper end of the links 480. In one example, a pin 466 may be inserted through the link plates 484 and the elevator link 480 to provide a pivotable connection. The lower end of the links 480 is coupled to the load ring 490. Pins may similarly be used to couple the links 480 to the load ring 490. The links 480 may be rigid or flexible and may have circular or polygonal cross-section. Any suitable number of links may be used, for example, two, three, four, or more links. The load ring 490 may be disposed below the flange 431 at the upper portion of the elevator 30, or other suitable location such as above the lift adapter 37, whereby axial load may be transferred between the load ring 490 and the elevator 30.

A bumper assembly 440 is optionally provided to limit insertion depth of the fill up tool in the casing 501. Referring to FIG. 10, the bumper assembly 440 is attached between the load transfer assembly 460 and the fill up tool 500. The bumper assembly 440 includes a base ring 442 having one or more holes for receiving a screw 444 and an engagement plate 446 positioned below the screws. The engagement plate 446 limits the insertion distance of the fill up tool inside the casing. In the event the casing is set too close to the engagement plate and cannot move axially upward to release from a slip, the screws 442 may be released to allow axial movement of the plate 446 relative to the casing. The load transfer assembly 460 may include a bracket as disclosed with respect to FIGS. 1 and 2.

Figure 10A:
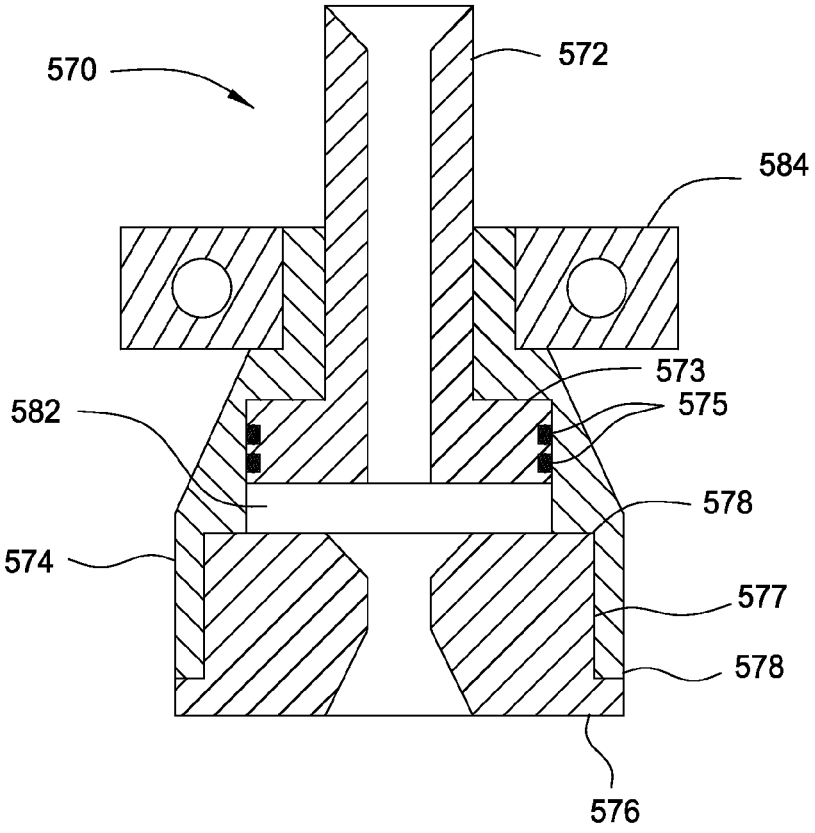
FIG. 10*a* illustrates another embodiment of a slip joint assembly.

FIG. 10*a* illustrates a partial cross-sectional view of another embodiment of the slip joint assembly 570. The slip joint assembly 570 includes a connection shaft 572 coupled to a connection housing 574. The upper end of the connection shaft 572 may connect to the output shaft of the top drive. The lower end of the connection shaft 572 includes a shoulder 573 configured to abut the interior of the connection housing 574. The outer diameter of the shoulder 573 and/or the shaft portion may include axial splines for mating with corresponding splines on the interior surface of the connection housing 574. In this respect, the connection shaft 572 is movable relative to the connection housing 574, while rotationally fixed relative to the connection housing 574. The splines allow the connection shaft 572 to transfer torque to the connection housing 574 for rotation. One of more seals 575 such as o-ring seals may be disposed between the connection shaft 572 and the connection housing 574 to prevent fluid leakage therebetween.

A connection adapter 576 attached to t he lower end of the connection housing 574 may be used to connect the slip joint 570 to the fill up tool 100. The connection adapter 576 may be attached to the connection housing 574 using a threaded connection 577. The connection adapter 576 may optionally include one or more shoulders 578 for abutting contact with the connection housing 574. In one embodiment, connection adapter 576 is configured such that an axial gap 582 exists between the connection adapter 576 and the lower end of the connection shaft 572. The axial gap 582 is preferably sufficiently large to prevent contact with connection shaft when an upward force is applied to the fill up tool 100.

Link plates 584 or other suitable connectors may be provided on the connection housing 574 for coupling with the upper end of the links 80 to the elevator 30. The lower end of the links 80 is coupled to the load ring 90. The load ring 90 may be positioned below the lift adapter 37 of the elevator 30 or other suitable location whereby axial load may be transferred between the load ring 90 and the elevator 30.

In operation, when a pressure increase in the well generates an upward force on the fill up tool 100, the upward force is transferred to the connection adapter 576 and the connection housing 574. In turn, the upward force is transferred to the link plates 584, the links 80, the load ring 90, and then the elevator 30. The upward force on the elevator 30 is countered by the downward force from the weight of the casing string. In this respect, the upward movement of the connection housing 574 is limited by the length of the links 80. Moreover, because of the axial gap 582, the connection adapter 576 cannot transfer the upward force to the connection shaft 572. In this manner, the output shaft of the top drive is substantially isolated from the upward force created by the pressure increase.

Figure 11:
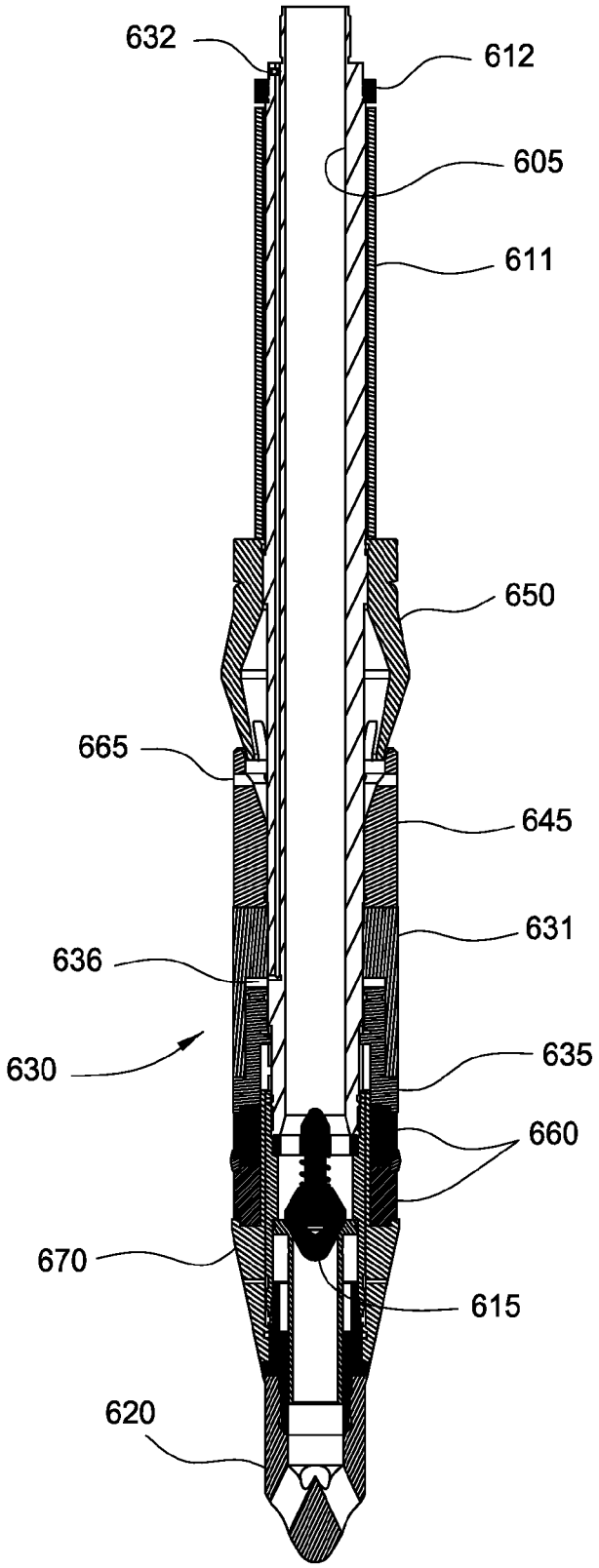
FIG. 11 illustrates another embodiment of a fill up tool.

FIG. 11 illustrates another embodiment of a fill up tool 600. In this embodiment, the selectively operable seal is hydraulically actuated. The fill up tool 600 may be used interchangeably with other fill up tool embodiments described herein.

The fill up tool 600 includes a mandrel 605, a primary sealing member 650, a secondary sealing member 660, and a mudsaver valve assembly 615. The mandrel 105 extends through the sealing member 650 and connects to the mudsaver valve assembly 615. The mandrel 605 includes a bore 610 that is in fluid communication with the mudsaver valve assembly 615 to allow fluid to flow through the tool 600. The mandrel 605 also includes an upper portion that is configured to connect the tool 600 to a wellbore tool, such as the output shaft of a top drive or a casing clamping tool. An optional spacer sleeve 611 and a mandrel nut 612 may be used to retain the components of the fill up tool on the mandrel 605 after assembly.

As shown, the primary sealing member 650 is disposed around the outer surface of the mandrel 605. Suitable sealing members include a packer such as a cup packer or other elastomeric packers. An exemplary primary sealing member include the sealing member 650 described with respect to FIGS. 3 and 4. The lower end of the sealing member 650 may be inserted into or surrounded by a cone sleeve 645. The cone sleeve 645 includes ports 665 for supplying fluid to energize the primary sealing member 650.

The tool 600 may further include a secondary sealing member 660 that is selectively operable. In one embodiment, the secondary sealing member 660 comprises an elastomeric material disposed on the mandrel of the mud valve 615 and against the guide sleeve 670. The mud valve mandrel is attached to the lower end of the fill up tool mandrel 650, while the guide sleeve 670 and the mud nozzle 620 are attached to the lower end of the mud valve mandrel.

The secondary sealing member 660 is activated using a hydraulic operated actuator 630. The actuator 630 includes a cylinder body 631 disposed below the cone sleeve 645. The cylinder body 631 is coupled to a piston 635. The piston 635 is configured to compress the secondary sealing member 660 against the guide sleeve 670. A hydraulic port 632 disposed at the upper end of the fill up tool 600 supplies hydraulic fluid to a chamber 636 defined between the body 631 and piston 635. A pressure increase in the chamber 636 moves the piston 635 toward the secondary sealing member 660, thereby applying a compressive force on the secondary sealing member 660. Upon compression, the secondary sealing member 660 expands outwardly into contact with the inner surface of the casing to form a secondary seal.

The fill up tool 600 may optionally include a locking device for retaining the secondary sealing member in the expanded position. In one embodiment, the locking device includes a j-slot lock having a pin coupled to a j-slot. In one embodiment, the j-slot may be formed on the piston 635 while the pin is on the mandrel 605. After compression of the secondary sealing member, the piston 635 is rotated relative to the pin, for example a quarter turn, to move pin relative along the j-slot. The j-slot maintains the piston 635 in position even if the hydraulic pressure is released. In another embodiment, the locking device may be a one-way valve such as a check valve disposed in a fluid channel between the hydraulic port 632 and the chamber 636. The one-way valve allows fluid pressure to be supplied to the chamber 636, while preventing release of the fluid pressure from the chamber 636. In this manner, pressure in the chamber 636 may be maintained.

In operation, the fill up tool 600 is connected to a lower end of the top drive output shaft or to a tubular gripping tool connected to the output shaft. The fill up tool 600 is inserted into a casing, which may be held by slips in the rig floor. After insertion, the primary sealing member 650 engages the inner diameter casing to provide a seal to prevent fluid from leaking out of the top of the casing. The sealing member 650 may be energized by air or fluid in the casing.

In the event of an unexpected increase in pressure in the casing, the secondary sealing member 660 may be activated to provide an additional seal in the casing. To initiate activation, hydraulic fluid is supplied through the port 632 at the top of the fill up tool 600. The hydraulic fluid fills the chamber 636 and urges the piston 635 toward the secondary seal 660, thereby compressing the secondary seal 660 against the guide sleeve 670. In this respect, the secondary sealing member 660 is "squeezed" outwardly into contact with the casing to form a secondary seal against the pressure kick. The secondary sealing member provides a sufficiently robust seal to contain the increased pressure in the well.

Figure 12:
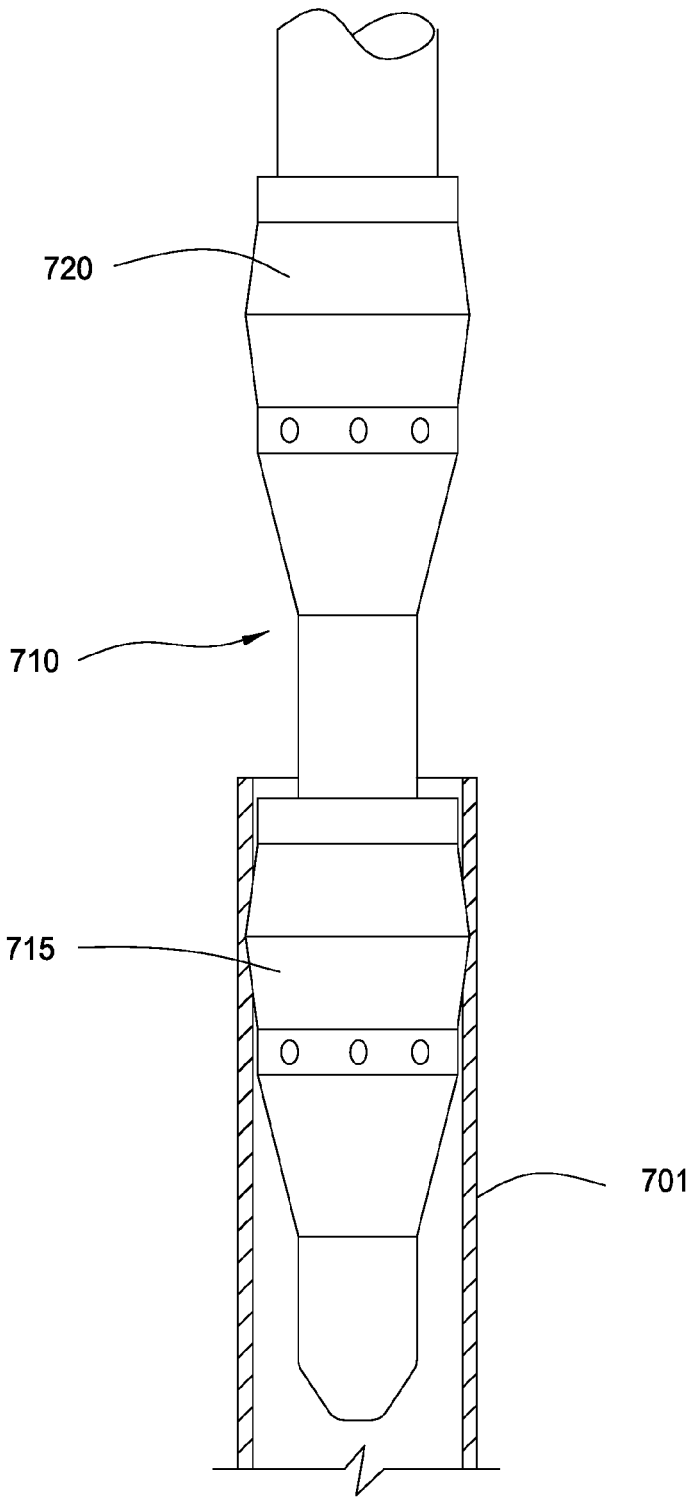
FIG. 12 is a perspective view of another embodiment of a fill up tool.

FIG. 12 shows another embodiment of a fill up tool 710 equipped with a primary packer 715 and a secondary packer 720. The fill up tool 710 is connectable to the top drive and is movable therewith. In one embodiment, the primary and the secondary packers 715, 720 may be any suitable packer known to a person of ordinary skill in the art. For example, the packers 715, 720 may be substantially similar to the sealing member 150 described in FIG. 3. It is contemplated the secondary packer 720 may be the same or different type of packer as the primary packer 715. The packers 715, 720 may be sized to form an interference fit with the interior of the casing. That is, the packers 715, 720 may have an outer diameter that is larger than the inner diameter of the casing. The packers 715, 720 may be energized by the fluid pressure insider the casing.

Figure 13:
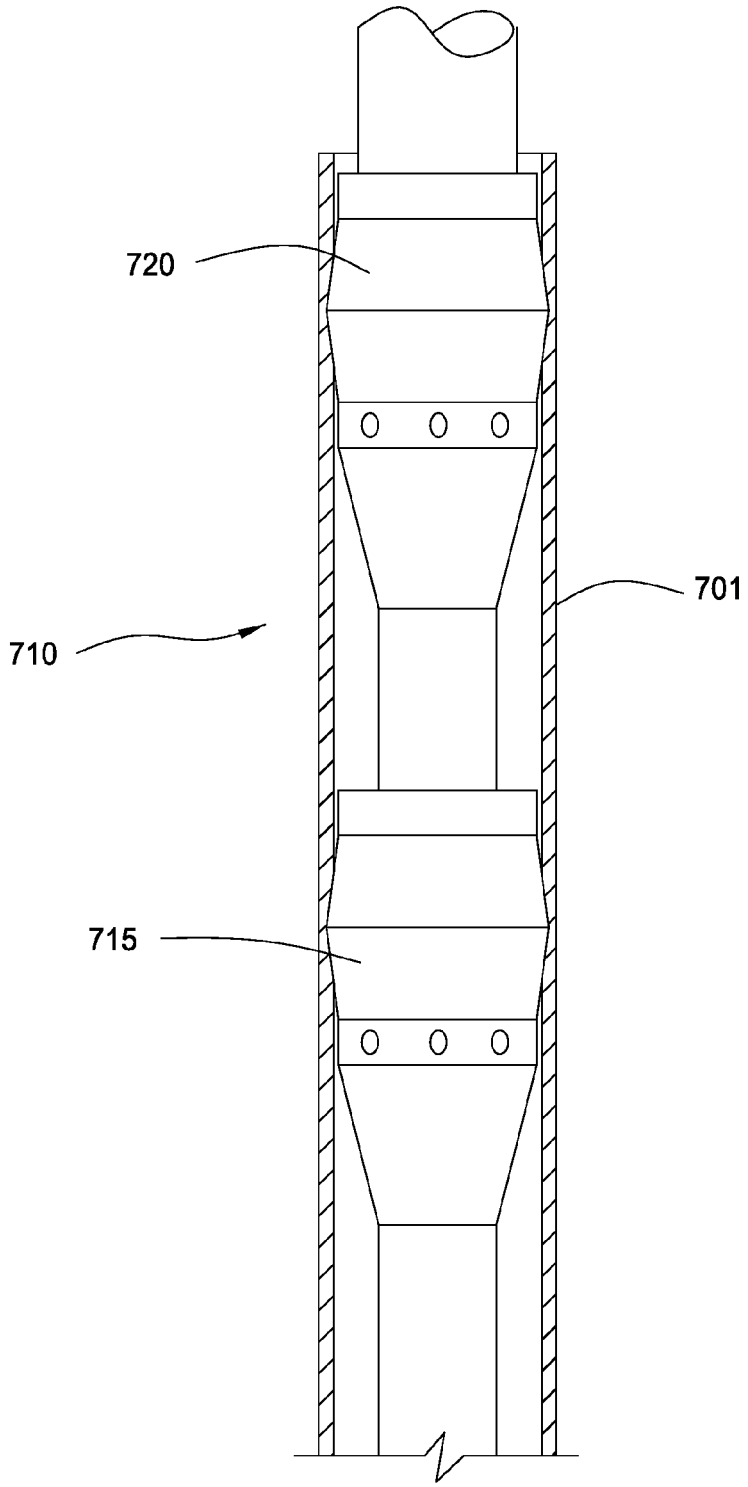
FIG. 13 shows the positions of the packers of the fill up tool of FIG. 12 during a blow out.

During routine fill up and/or circulating operations, the primary packer 715 is inserted into the casing 701 and the secondary packer 720 remains outside (e.g., above) of the casing 710, as shown in FIG. 12. In this respect, the primary packer 715 is used repeatedly, while the secondary packer 720 is not used repeatedly. During a blow out prevention or an emergency situation, the secondary packer 720 is inserted into the casing 701 to help seal against the blow out, as shown in FIG. 13. Because it had not been used repeatedly, the secondary packer 720 is assured of its effectiveness to seal against a blow out.

Figure 14:
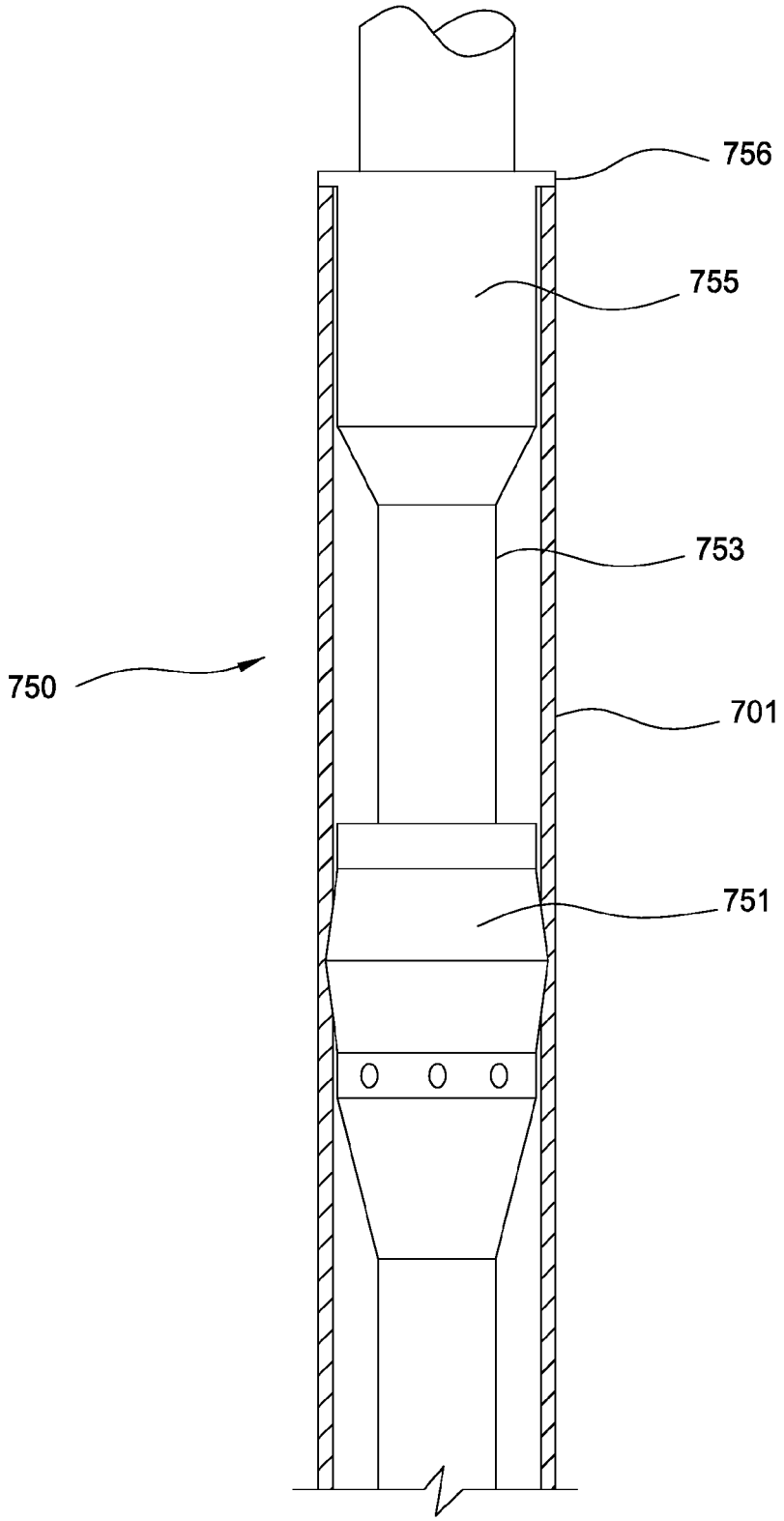
FIG. 14 is a perspective view of another embodiment of a fill up tool.
Figure 15:
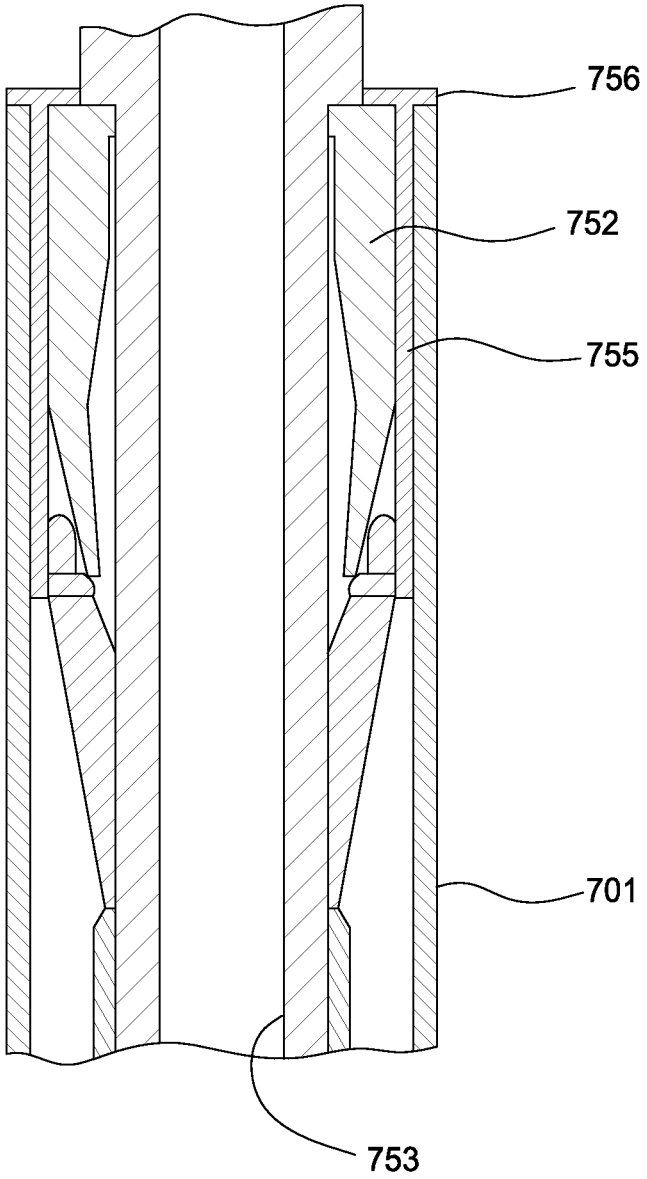
FIG. 15 is a partial cross-sectional view of the fill up tool of FIG. 14.
Figure 16:
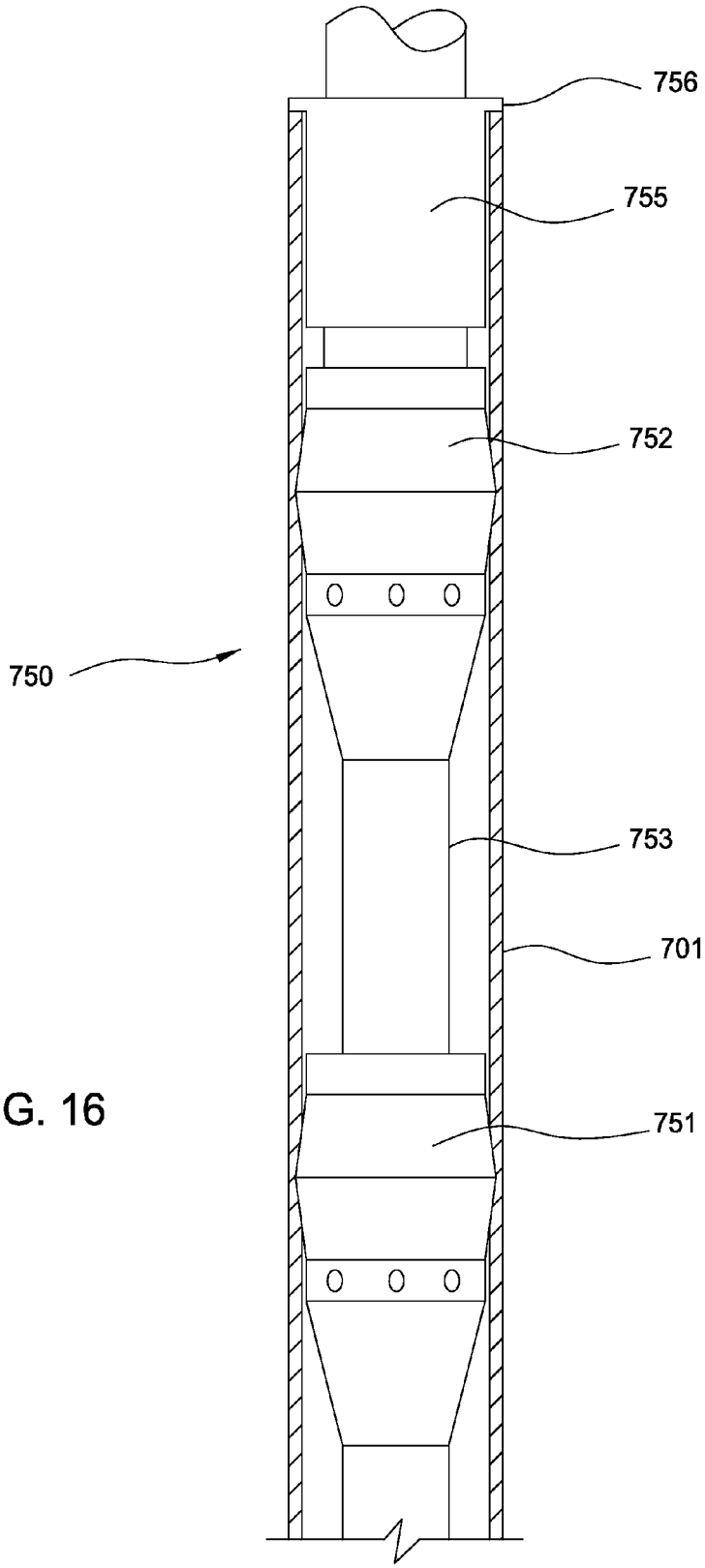
FIG. 16 shows the positions of the packers of the fill up tool of FIG. 14

FIGS. 14-16 illustrate another embodiment of a fill up tool 750. The fill up tool 750 includes a primary packer 751 and a secondary packer 752. In one embodiment, a retainer housing 755 is used to contain the secondary packer 752 in a compressed state before being deployed in the casing 701. The housing 755 may be a tubular sleeve having an outer diameter that is smaller than an inner diameter of the casing. The housing 755 may have a flange 756 disposed on the exterior of the housing 755. In one embodiment, the flange 756 is adapted to provide a total width that is greater than the inner diameter of the casing 701. For example, the flange 756 may be an annular flange having an outer diameter that is greater than the inner diameter of the casing 701. In another example, the flange 756 may be a plurality of extension elements formed on the exterior of the housing 755, e.g., four extension elements spaced circumferentially on the flange 755 exterior. The extension elements are sized to abut against the upper portion of the casing 701. In the embodiment shown in FIG. 14, the flange 756 is a bumper plate formed an upper end of the housing 755. It is contemplated that the flange 756 may be formed on any axial position on the housing 755. The secondary packer 752 may be any suitable packer for sealing against the casing, such as the sealing member 150 described in FIG. 3.

The housing 755 may be movable relative to the secondary packer 752. In one embodiment, the housing 755 is releasably attached to the secondary packer 752 or the mandrel 753 of the fill up tool 750. The housing 755 may release from the secondary packer 752 or the mandrel 753 when a predetermined force is applied. The housing 755 may be releasably attached using a shearable member such screw, clip, adhesive, or combinations thereof.

During routine fill up and/or circulating operations, the primary packer 751 is inserted into the casing 701 and the secondary packer 752 remains outside of the casing 701. The secondary packer 752 is at least partially held inside the housing 755. During a blow out prevention or emergency, the secondary packer 752 is inserted into the casing 701 to help seal against a blow out, as shown in FIG. 14. FIG. 15 is a partial cross-sectional view of Figure x3. In FIGS. 14 and 15, the flange 756, in this case a bumper plate, has landed on the top of the casing 701. The bumper plate prevents the housing 755 from moving lower as the secondary packer 752 is lowered further inside casing 701. The secondary packer 752 is thus released out of the housing 755 and allowed to expand against the casing 701, thereby forming a seal. FIG. 16 shows the secondary packer 752 released from the housing 755 and engaged with the casing 701, thereby providing an additional seal against a pressure kick.

Figure 17:
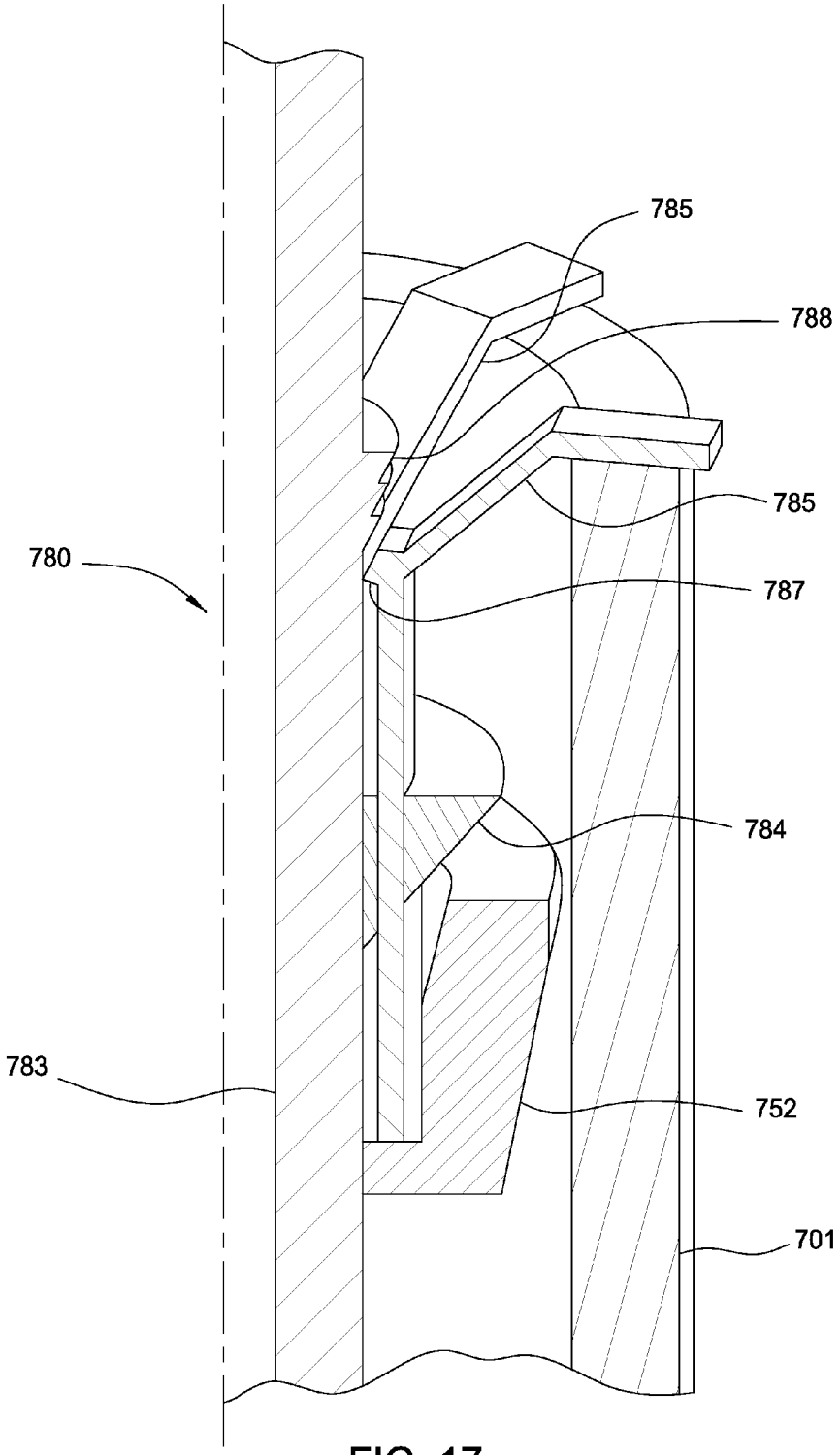
FIG. 17 is a partial cross-sectional view of another embodiment of a secondary packer of a fill up tool.
Figure 18:
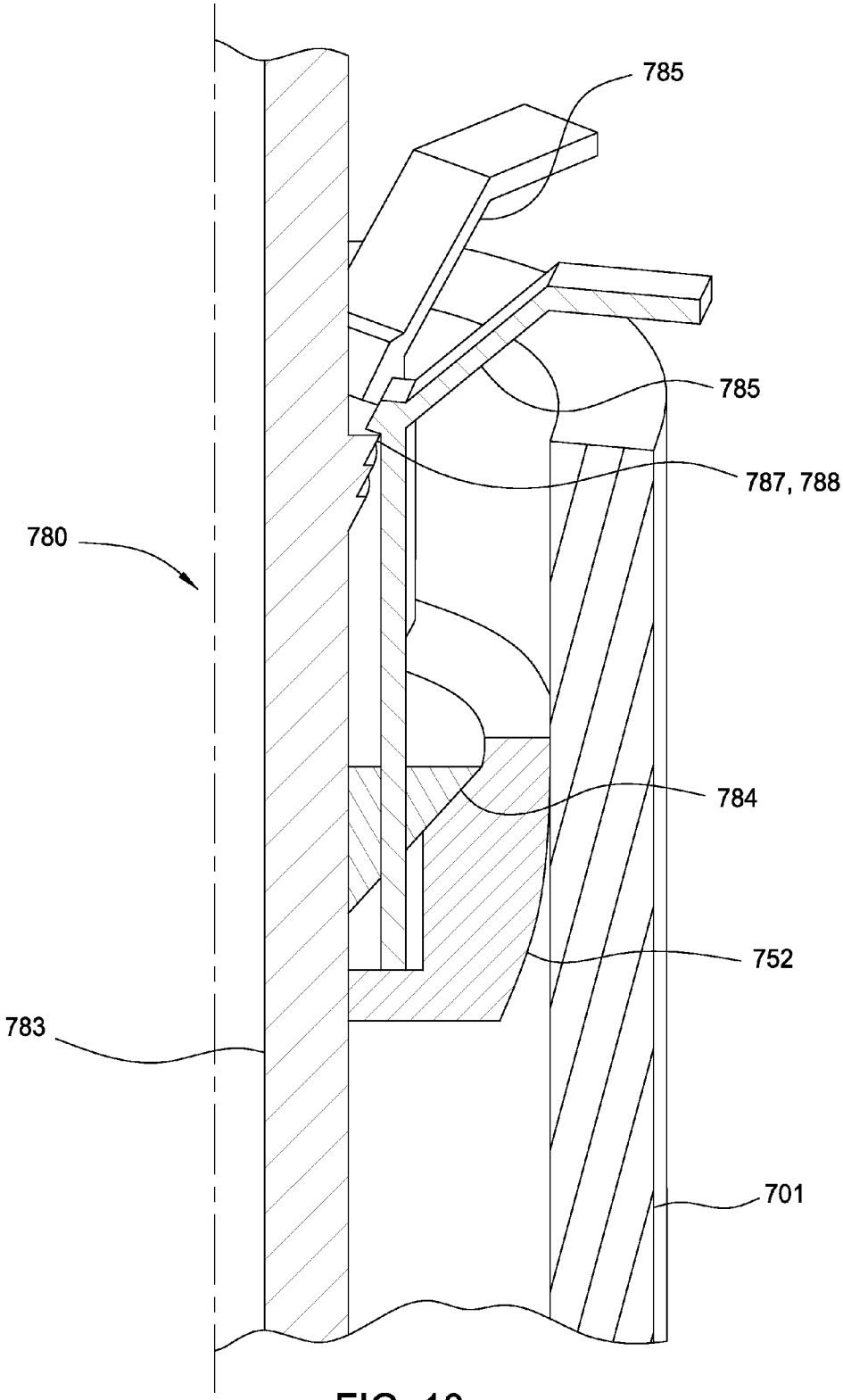
FIG. 18 is a partial cross-sectional view of the secondary packer of FIG. 17 in the activated position.

FIGS. 17-18 illustrate another embodiment of a fill up tool 780 having a primary packer (not shown) and a secondary packer 782. In one embodiment, the secondary packer 782 may be actuated using a downward force. The primary packer may be any suitable packer such as the sealing member 150 of FIG. 3. FIG. 17 shows a secondary packer 752 coupled to a mandrel 783, which may be connected to or is an extension of the mandrel of the fill up tool 780. The mandrel 783 includes a mandrel wedge 784 for engaging the packer 752. The packer 752 has an upward facing recess for receiving the mandrel wedge 784. The packer 752 is attached to a plurality of links 785 that are movable relative to the mandrel wedge 784. In one embodiment, the links 785 are movable in a slot of the mandrel wedge 784. The other end of the links 785 is adapted to abut the casing 701.

In another embodiment, the links 785 may optionally include one or more teeth 787 for mating with corresponding teeth 788 on the mandrel 783. After mating, the teeth 787 prevent the packer 752 from moving downwardly relative to the mandrel 783.

In an emergency such as a blow out, the fill up tool 780 including the secondary packer 752 is inserted into the casing 701 until the upper end of the links 785 abuts the casing 701, as shown in FIGS. 17 and 18. As the tool 780 is lowered further, the mandrel wedge 784 is moved downwardly relative to the packer 752 and into the recess of the packer 752. After entering the recess, the wedge 784 expands the packer 752 into sealing engagement with the casing 701, as shown in FIG. 18. To keep the packer 752 from disengaging, the link teeth 787 are engaged with the mandrel teeth 788, as shown in FIG. 18. In this manner, the secondary packer 752 is actuated to provide an additional seal in the casing 701.

Figure 19:
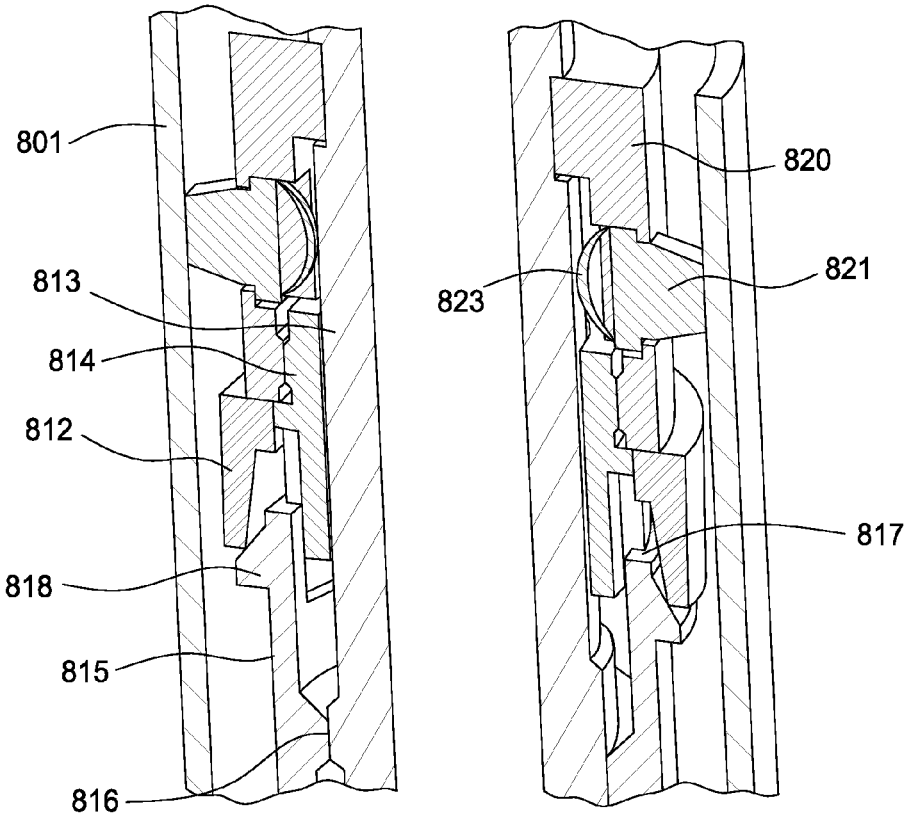
FIG. 19 is a partial cross-sectional view of another embodiment of a secondary packer of a fill up tool.
Figure 20:
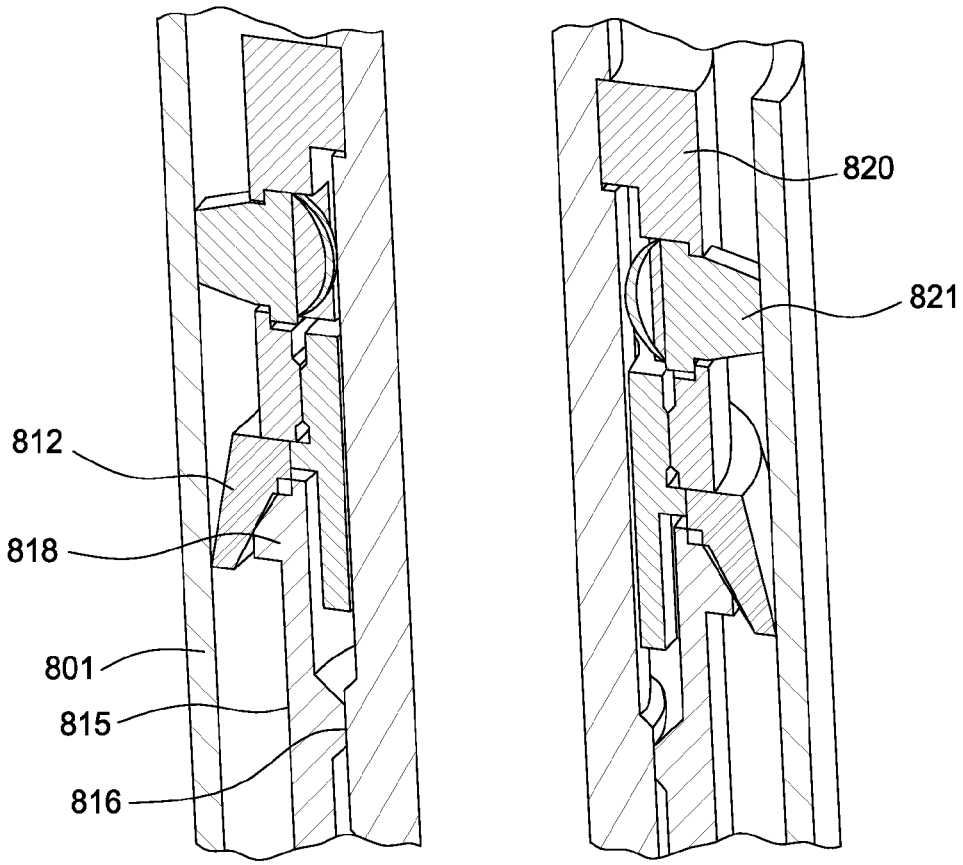
FIG. 20 is a partial cross-sectional view of the secondary packer of FIG. 19 in the activated position.

FIGS. 19-20 illustrate another embodiment of a fill up tool 800 having a primary packer (not shown) and a secondary packer 812. In FIG. 19, the secondary packer 812 is coupled to the main mandrel 813 using a support mandrel 814. The packer 812 has a downward facing recess. The support mandrel 814 is coupled to a threaded mandrel 815 using a spline and groove connection 817. The threaded mandrel 815 is threadedly coupled to the main mandrel 813 using a threaded connection 816. The threaded mandrel 815 has a wedge 818 formed at its upper end for engaging the packer 812. A jaw sleeve 820 for retaining a plurality of jaws 821 is connected to the support mandrel 814. The jaws 821 are biased outwardly using a biasing member 823 such as a spring. The support mandrel 814 and the jaw mandrel 820 are rotatable relative to the main mandrel 813. The threaded mandrel 815 is rotatable and axially movable relative to the main mandrel 813.

In an emergency such as a blow out, the secondary packer 812 is stabbed into the casing 801 and the spring loaded jaws 821 grip the inner diameter of the casing 801, as shown in FIG. 19. The jaws 821 prevent rotation of the support mandrel 814. Thereafter, the main mandrel 813 is rotated by the top drive relative to the threaded mandrel 815. Rotation of the threads 816 causes the threaded mandrel 815 to move upwardly relative to the main mandrel 813 and the support mandrel 814 via the spline connection 817. In this respect, the wedge 818 of the threaded mandrel 815 engages and expands the packer 812 into sealing contact with the casing 801, as shown in FIG. 20.

Figure 21:
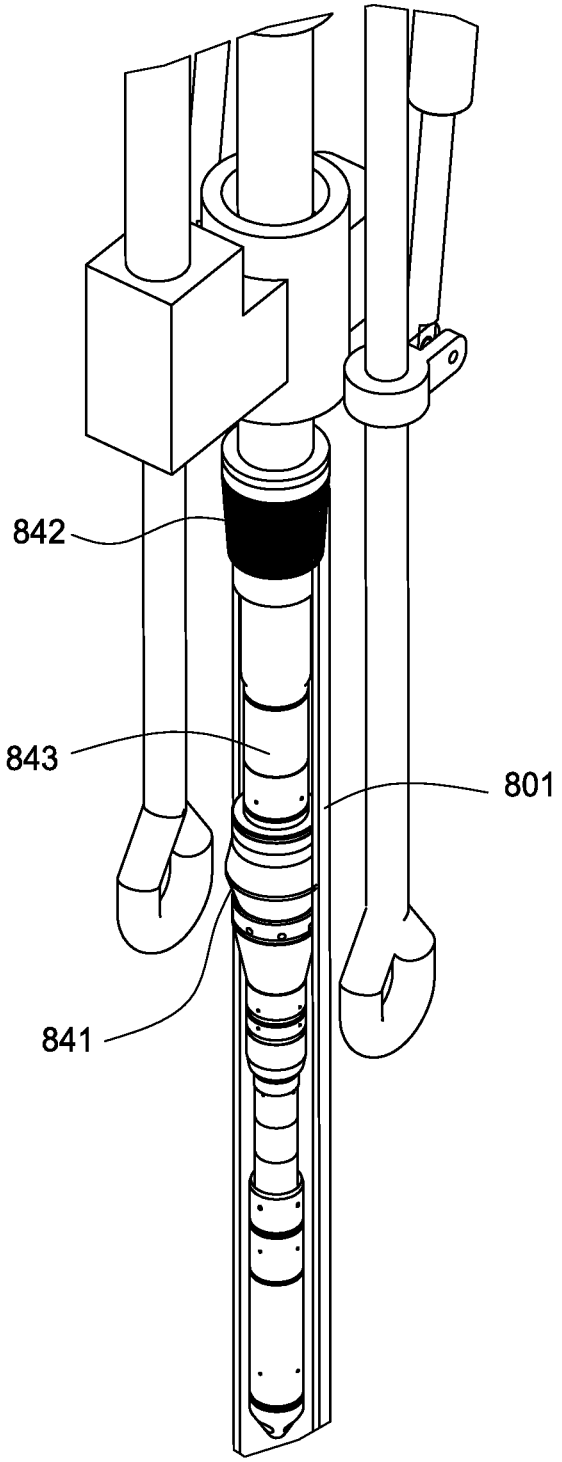
FIG. 21 is a view of another embodiment of a secondary packer of a fill up tool.

In another embodiment, a secondary sealing member may be a casing cap 842 connectable to the casing 801. As shown in FIG. 21, the casing cap 842 may be positioned on the main mandrel 843 and above the primary packer 841. The casing cap 842 has outwardly facing threads adapted to engage the threads of the casing 801. During routine fill up operations, the casing cap 842 remains outside of the casing 801.

In the event of a shut off, the casing cap 842 is lowered toward the casing 801 and then rotated relative to the casing 801 to threadedly connect the casing cap 842 to the casing 801. FIG. 21 shows the casing cap 842 connected to the casing 801. In this manner, the blowout may be contained in the casing 801 below the casing cap 842.

Figure 22:
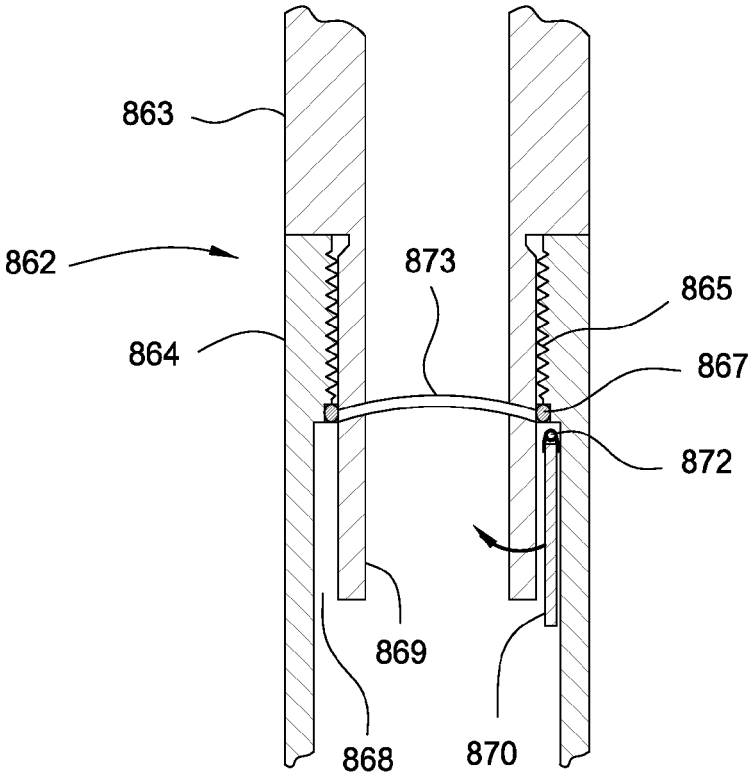
FIG. 22 is a partial cross-sectional view of another embodiment of a secondary packer of a fill up tool.
Figure 22A:
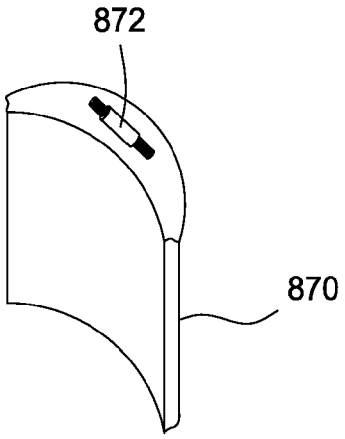
FIG. 22*a* is a perspective of the flapper door of the secondary packer.

In another embodiment, the secondary sealing member of a fill up tool may include a valve. FIG. 22 shows an embodiment of a flapper valve assembly 862 being used as a sealing member on the fill up tool. As shown, the flapper valve assembly 862 includes an upper mandrel 863 connected to a lower mandrel 864 using a threaded connection 865. The upper and lower mandrels 863, 864 are coupled to the main mandrel of the fill up tool. An o-ring 867 may be positioned between the upper and lower mandrels 863, 864 to prevent leakage. The upper mandrel has a lower extended portion 869 that extends pass the threaded connection 865. An annular area 868 is defined between the lower extended portion 869 and the lower mandrel 864. The flapper door 870 is pivotally connected to the lower mandrel 864 and disposed in the annular area 868. A torsion sprung hinge 872 may be used to pivotally couple the flapper door 870 to the lower mandrel 864. The hinge 872 is configured to bias the flapper door 870 to the closed position where it engages a mating profile 873 formed on the interior surface of the lower mandrel 864. FIG. 22*a* illustrates an embodiment of the flapper door 870 and the hinge 872. The flapper door 870 is maintained in the open position by an extended portion 869 of the upper mandrel 863.

In the event of a shut off, the upper mandrel 863 is rotated relative to the lower mandrel 864 to separate the upper and lower mandrels 863, 864. Upon removal of the upper mandrel 863, the lower extended portion 869 is moved away from the flapper door 870. The flapper door 870 is allowed to pivot to the closed position, thereby closing the bore of the lower mandrel 864. Removal of the upper mandrel 863 also allows the top drive to disconnect from the fill up tool.

Figure 23:
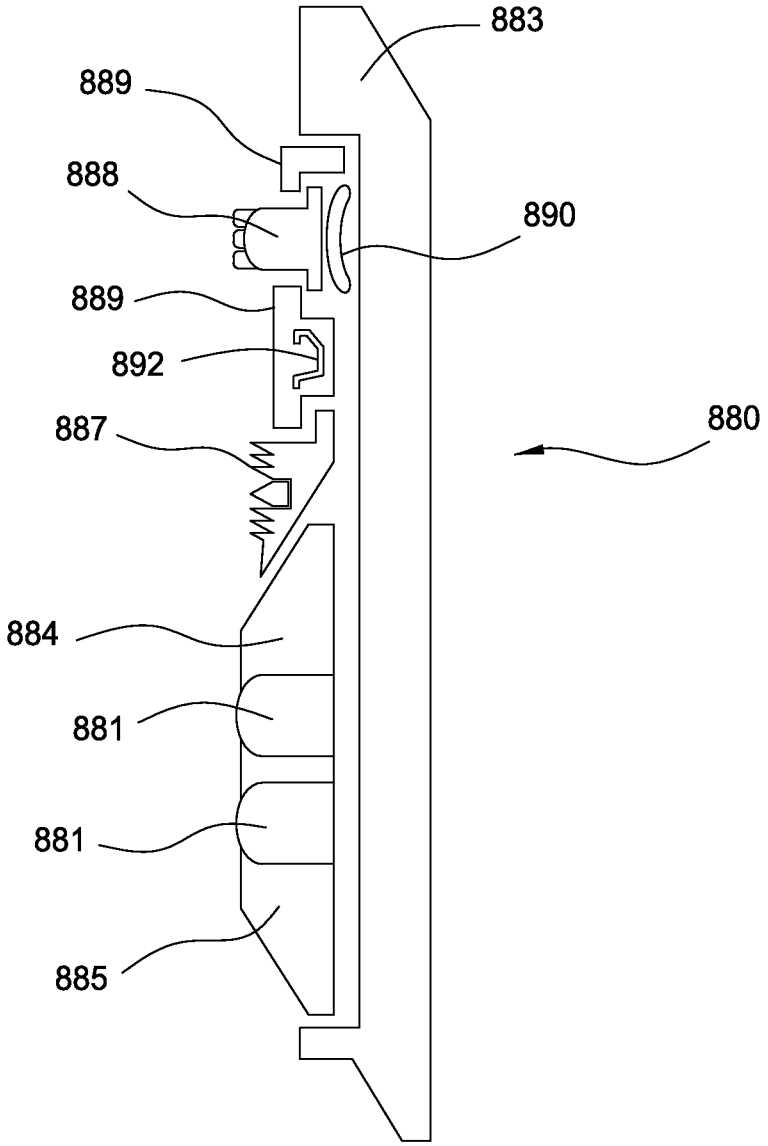
FIG. 23 is a partial cross-sectional view of another embodiment of a secondary packer of a fill up tool.

In another embodiment, the fill up tool is equipped with a packer assembly 880 for use as a secondary packer, as shown in FIG. 23. The packer assembly 880 is coupled to the mandrel 883 of the fill up tool and may be mechanically actuated. In the example as shown, the packer assembly 880 includes one or more packing elements 881 disposed between two wedges 884, 885. The packer assembly 880 is supported in a recess of the mandrel 883 such that the lower wedge 885 is disposed at a lower end of the recess. Gripping members 887 such as slips are positioned above the upper wedge 884. Optionally, a lower gripping member may be positioned below the lower wedge 885. Also, friction members 888 such as drag blocks are positioned on the recess and retained by a housing 889. The drag blocks may be biased outward using a biasing member 890 such as a spring. The housing includes one or more j-slots 892 formed therein. The j-slot 892 cooperates with a pin on the mandrel 883 to control relative movement between the housing 889 and the mandrel 883.

In operation, the packer assembly 880 is stabbed into the casing. The drag blocks 888 are biased against the inner diameter of the casing and frictionally engage the casing. The drag blocks 888 engage the casing sufficiently to counteract torque and upward pull. Thereafter, the mandrel 883 is pulled upward and rotated to the right to move the pin on the mandrel 883 out of the j-slot 892. Then, the mandrel 883 is pulled further up relative to the j-slot 892. In this respect, the packer assembly 880 is pulled against the slips 887, thereby forcing the slips 887 outward and compressing the packing elements 881 outward against the inner diameter of the casing. As the pin reaches the top of the j-slot 892, the mandrel 883 is rotated to the left. Then, weight is slacked off to set the pin in the j-slot 892. In this manner, the packer 880 may be set inside the casing.

In another embodiment, the packer assembly may be actuated using a different type of j-slot mechanism. In operation, the fill up tool is stabbed into casing. The drag blocks grip the inner diameter of the casing sufficiently to counteract torque and upward pull. The mandrel is pulled upward and rotated ⅓ turn to move a pin on the mandrel out of the j-slot. Then, the mandrel is pulled further upward and the pin follows the j-slot up. As the mandrel is being pulled up, the packer assembly is being pulled up against the slips, forcing the slips and compressing the packers outward against the inner diameter of the mandrel. As the pin on the mandrel reach the top of the j-slot, the mandrel is rotated ⅓ turn back and slack off weight to set the pin in the j-slot. The packer is now set.

In another embodiment, a fill up tool includes a mandrel; a primary sealing member disposed on the mandrel; a selectively operable secondary sealing member; and a housing for containing the secondary sealing member, wherein the secondary sealing member is axially movable relative to the housing. In another embodiment, the retainer is adapted to abut the casing. In yet another embodiment, the secondary sealing member comprises a packer having a recess.

In another embodiment, a fill up tool includes a mandrel; a primary sealing member disposed on the mandrel; a selectively operable secondary sealing member; and an actuator configured to expand the secondary sealing member by engaging an interior surface of the second sealing member. In one embodiment, the actuator is axially movable relative to the secondary sealing member. In another embodiment, the actuator comprises a wedge. In yet another embodiment, the actuator is moved axially by rotating the mandrel. In yet another embodiment, the tool includes an anti-rotation device configured to prevent rotation of the secondary sealing member relative to the mandrel.

In another embodiment, a fill up tool for use with a tubular includes a mandrel; a primary sealing member disposed on the mandrel; and a selectively operable secondary sealing member having threads configured to mate with threads on the tubular.

In another embodiment, a fill up tool having a mandrel; a primary sealing member disposed on the mandrel; and a selectively operable valve assembly configured to block fluid communication through the mandrel.

In another embodiment, a fill up tool having a mandrel; a primary sealing member disposed on the mandrel; and a selectively operable secondary sealing assembly activatable using a compressive force. In one embodiment, the sealing assembly includes a sealing element and a friction member for engaging a casing. In another embodiment, the assembly includes a j-slot configured to selectively activate the sealing element.

In another embodiment, a fill up tool for use with a top drive includes a mandrel; a sealing member disposed on the mandrel; and a load transfer assembly configured to limit transfer of an upward force from the mandrel to the top drive. In one embodiment, the tool includes an elevator coupled to the top drive, whereby the upward force is transferred to the elevator. In another embodiment, the load transfer assembly includes a slip joint for connecting the load transfer assembly to the top drive; a load ring coupled to the elevator; and a link coupling the slip joint to the load ring. In yet another embodiment, the tool includes a second sealing member selectively activatable by rotating the mandrel.

While the foregoing is directed to embodiments of the present invention, other and further embodiments of the invention may be devised without departing from the basic scope thereof, and the scope thereof is determined by the claims that follow.

The invention claimed is:

1. A fill up tool, comprising:
a mandrel;
a primary sealing member disposed on the mandrel; and
a selectively operable secondary sealing member activatable by rotation of the mandrel.

2. The tool of claim 1, further comprising an anti-rotation assembly to inhibit relative rotation of the secondary sealing member with the mandrel.

3. The tool of claim 2, further comprising an actuator coupled to the anti-rotation assembly and the mandrel.

4. The tool of claim 3, wherein the rotation of the mandrel causes axial movement of the actuator.

5. The tool of claim 1, wherein rotation of the mandrel applies a compressive force on the secondary sealing member.

6. The tool of claim 1, further comprising a load transfer assembly configured to limit transfer of an upward force from the mandrel.

7. The tool of claim 1, wherein the secondary sealing member is disposed below the primary sealing member.

8. The tool of claim 1, wherein the secondary sealing member engages an inner surface of the casing.

9. The tool of claim 1, wherein the mandrel is configured for insertion into a casing, wherein the mandrel is configured to be inserted into the casing by a first amount and by a second amount, wherein the second amount is deeper than the first amount.

10. The tool of claim 9, wherein the primary sealing member is configured to seal with the casing when the mandrel is inserted into the casing by the first or second amount.

11. The tool of claim 9, wherein secondary sealing member is activatable by rotation of the mandrel only when the mandrel is inserted into the casing by the second amount.

12. A fill up tool, comprising:
a mandrel;
a primary sealing member disposed on the mandrel;
a selectively operable secondary sealing member disposed on the mandrel; and
a housing for containing the secondary sealing member, wherein the secondary sealing member is axially movable relative to the housing.

13. The fill up tool of claim 12, wherein the housing is at least partially inserted into a casing.

14. The fill up tool of claim 13, wherein the housing is adapted to abut the casing.

15. The fill up tool of claim 12, wherein the secondary sealing member comprises a packer having a recess.

16. A method of running casing, comprising:
providing a fill up tool equipped with a mandrel, a first sealing member, and a second sealing member;
inserting the fill up tool into the casing;
forming a first seal with the casing using the first sealing member;
activating the second sealing member by rotating the mandrel, thereby forming a second seal.

17. The method of claim 16, wherein rotating the mandrel causes an actuator to apply a compressive force on the second sealing member.

18. The method of claim 16, further comprising conducting a fill up operation prior to activating the second sealing member.

19. The method of claim 18, wherein the second sealing member is located outside of the casing.

20. The method of claim 16, wherein the second sealing member engages an inner surface of the casing.

21. The method of claim 16, wherein the second sealing member engages an outer surface of the casing.

* * * * *